US009290312B2

(12) United States Patent
Brown

(10) Patent No.: US 9,290,312 B2
(45) Date of Patent: Mar. 22, 2016

(54) DOUBLE-WALLED CONTAINER

(71) Applicant: Dart Container Corporation, Mason, MI (US)

(72) Inventor: Alexander Brown, Manningtree (GB)

(73) Assignee: Dart Container Corporation, Mason, MI (US)

( * ) Notice: Subject to any disclaimer, the term of this patent is extended or adjusted under 35 U.S.C. 154(b) by 87 days.

(21) Appl. No.: 13/966,884

(22) Filed: Aug. 14, 2013

(65) Prior Publication Data

US 2015/0048086 A1 Feb. 19, 2015

(51) Int. Cl.
*B65D 81/38* (2006.01)
*B65D 1/40* (2006.01)

(52) U.S. Cl.
CPC ..... *B65D 81/3869* (2013.01); *B65D 1/40* (2013.01)

(58) Field of Classification Search
CPC ..... B65D 1/40; B65D 81/3869; B65D 3/22; B65D 3/28; B65D 21/0233
See application file for complete search history.

(56) References Cited

U.S. PATENT DOCUMENTS

| | | | | |
|---|---|---|---|---|
| 1,041,504 | A | 10/1912 | Moore | |
| 1,814,671 | A | 7/1931 | Dufour | |
| 2,186,338 | A * | 1/1940 | Mills | 220/288 |
| 2,266,828 | A * | 12/1941 | Sykes | 229/403 |
| 2,602,383 | A | 7/1952 | Barbieri | |
| 2,675,954 | A | 4/1954 | Vogel | |
| 3,908,523 | A | 9/1975 | Shikaya | |
| 4,007,670 | A | 2/1977 | Albano et al. | |
| 4,435,344 | A | 3/1984 | Iioka | |
| 4,548,348 | A * | 10/1985 | Clements | 220/738 |
| 5,145,107 | A | 9/1992 | Silver et al. | |
| 5,326,019 | A | 7/1994 | Wolff | |
| 5,363,982 | A | 11/1994 | Sadlier | |
| 5,385,260 | A | 1/1995 | Gatcomb | |
| 5,460,323 | A | 10/1995 | Titus | |
| 5,524,817 | A | 6/1996 | Meier et al. | |
| 5,547,124 | A | 8/1996 | Mueller | |
| 5,660,326 | A | 8/1997 | Varano et al. | |
| 5,685,480 | A | 11/1997 | Choi | |
| RE35,830 | E | 6/1998 | Sadlier | |
| 5,769,311 | A | 6/1998 | Morita et al. | |
| 5,839,653 | A | 11/1998 | Zadravetz | |
| 6,109,518 | A | 8/2000 | Mueller et al. | |
| 6,129,653 | A | 10/2000 | Fredricks et al. | |
| 6,139,665 | A | 10/2000 | Schmelzer et al. | |
| 6,152,363 | A | 11/2000 | Rule, Jr. | |
| 6,193,098 | B1 | 2/2001 | Mochizuki et al. | |

(Continued)

FOREIGN PATENT DOCUMENTS

| | | |
|---|---|---|
| DE | 102006025612 A1 | 11/2007 |
| DE | 102010037168 A1 | 3/2012 |

(Continued)

*Primary Examiner* — Andrew Perreault
(74) *Attorney, Agent, or Firm* — McGarry Bair PC

(57) ABSTRACT

A double-walled container including an inner sleeve, an outer sleeve and a base is provided. The inner sleeve is positioned within the outer sleeve. A sidewall cavity may be formed between an inner sleeve sidewall and an outer sleeve sidewall. The lower end of the outer sleeve forms an elongated loop located below a lowermost edge of the inner sleeve. A flange may extend from the elongated loop upwardly above the lowermost edge of the inner sleeve and is attached to the inner sleeve. The elongated loop may form a loop cavity. The loop cavity may be in fluid communication with the sidewall cavity.

24 Claims, 10 Drawing Sheets

(56) References Cited

U.S. PATENT DOCUMENTS

| | | | |
|---|---|---|---|
| 6,196,454 | B1 | 3/2001 | Sadlier |
| 6,308,883 | B1 | 10/2001 | Schmelzer et al. |
| 6,378,766 | B2 | 4/2002 | Sadlier |
| 6,382,449 | B1 | 5/2002 | Kazmierski et al. |
| 6,416,829 | B2 | 7/2002 | Breining et al. |
| 6,422,456 | B1 | 7/2002 | Sadlier |
| 6,482,481 | B1 | 11/2002 | Fredricks et al. |
| 6,565,934 | B1 | 5/2003 | Fredricks et al. |
| 6,598,786 | B1 | 7/2003 | Guo |
| 6,663,926 | B1 | 12/2003 | Okushita et al. |
| 6,663,927 | B2 | 12/2003 | Breining et al. |
| 6,676,586 | B2 | 1/2004 | Breining et al. |
| 6,703,090 | B2 | 3/2004 | Breining et al. |
| 6,749,913 | B2 | 6/2004 | Watanabe et al. |
| 6,802,938 | B2 | 10/2004 | Mohan et al. |
| 6,926,197 | B2 | 8/2005 | Hed et al. |
| 7,056,563 | B2 | 6/2006 | Halabisky |
| 7,060,159 | B2 | 6/2006 | Halabisky |
| 7,074,466 | B2 | 7/2006 | DeBraal et al. |
| 7,100,770 | B2 | 9/2006 | D'Amato |
| 7,175,585 | B2 | 2/2007 | Okushita et al. |
| 7,458,504 | B2 | 12/2008 | Robertson et al. |
| 7,481,356 | B2 | 1/2009 | Stahlecker |
| 7,677,435 | B2 | 3/2010 | Stahlecker |
| 7,699,216 | B2 | 4/2010 | Smith et al. |
| 7,717,325 | B2 | 5/2010 | Puls et al. |
| 7,717,352 | B2 | 5/2010 | Loffelsend et al. |
| 7,905,821 | B2 | 3/2011 | Stahlecker |
| 7,922,071 | B2 | 4/2011 | Robertson et al. |
| 7,993,254 | B2 | 8/2011 | Robertson et al. |
| 8,132,687 | B2 | 3/2012 | Fedusa et al. |
| 8,172,127 | B2 | 5/2012 | Frost et al. |
| 8,191,708 | B2 | 6/2012 | D'Amato |
| 8,360,263 | B2 | 1/2013 | D'Amato |
| 2002/0172818 | A1 | 11/2002 | DeBraal et al. |
| 2006/0144915 | A1 | 7/2006 | Sadlier |
| 2006/0226210 | A1* | 10/2006 | Stahlecker ..... 229/403 |
| 2007/0262129 | A1 | 11/2007 | Zadravetz |
| 2008/0121681 | A1 | 5/2008 | Wiedmeyer |
| 2008/0128481 | A1 | 6/2008 | Robertson |
| 2009/0184020 | A1 | 7/2009 | Messerschmid et al. |
| 2009/0230178 | A1 | 9/2009 | Stahlecker et al. |
| 2009/0321508 | A1 | 12/2009 | Fu et al. |
| 2010/0065622 | A1 | 3/2010 | Chang |
| 2010/0072268 | A1 | 3/2010 | Johnson et al. |
| 2011/0174656 | A1 | 7/2011 | D'Amato |
| 2011/0215103 | A1 | 9/2011 | Lee |
| 2011/0240726 | A1 | 10/2011 | Stahlecker |
| 2011/0272459 | A1 | 11/2011 | Hoekstra et al. |
| 2012/0006888 | A1 | 1/2012 | D'Amato |
| 2012/0048450 | A1 | 3/2012 | Fu et al. |
| 2012/0048918 | A1 | 3/2012 | Hougland et al. |
| 2012/0097685 | A1 | 4/2012 | Babinsky et al. |
| 2012/0118944 | A1 | 5/2012 | Stahlecker |
| 2012/0199641 | A1 | 8/2012 | Hsieh |
| 2012/0261427 | A1 | 10/2012 | Bates |
| 2013/0001286 | A1 | 1/2013 | Stahlecker |

FOREIGN PATENT DOCUMENTS

| | | | |
|---|---|---|---|
| EP | 2149509 | A1 | 2/2010 |
| JP | 04201840 | | 7/1992 |
| JP | 3058921 | U | 6/1999 |
| JP | 3248718 | B2 | 1/2002 |
| JP | 4094730 | B2 | 6/2008 |
| WO | 2010019146 | A1 | 2/2010 |
| WO | 2011023400 | A1 | 3/2011 |

* cited by examiner

DOUBLE-WALLED CONTAINER

TECHNICAL FIELD

The present invention relates generally to a double-walled container and more specifically to a container having an outer sleeve and an inner sleeve.

BACKGROUND OF THE INVENTION

Various methods, containers and auxiliary devices for providing insulation to a container to keep the contents of a container warm/cold and to lessen the effects of the transfer of heat to or from a user's hand are known in the art. For example, U.S. Pat. No. 7,699,216, titled "Two-Piece Insulated Cup," issued to Smith et al. on Apr. 20, 2010, which is hereby incorporated by reference in its entirety, describes an insulating vessel formed with ribs located between sidewalls of an inner cup and an outer cup. The inner cup may be formed of paper; the outer cup may be formed of a thermoplastic. As other examples, corrugated substrates may be provided to form portions of a container and/or coatings may be provided on one or more surfaces.

Other known containers may incorporate stacking features and/or stiffening features, such as ridges, ledges, ribs, indentations, etc. Forming each of these features generally requires a separate manufacturing step or increases the complexity of the manufacturing process. Further, containers formed of multiple parts or complexly formed parts may also increase the complexity and cost of the manufacturing process.

Thus, while insulating containers and jackets according to the prior art may provide a number of advantageous features, they nevertheless may have certain limitations. The present invention seeks to overcome certain of these limitations and other drawbacks of the prior art, and to provide new features not heretofore available.

SUMMARY OF THE INVENTION

The present invention generally provides a double-walled container or an insulating vessel for beverages or other foods.

According to certain aspects, the double-walled container includes an inner sleeve and an outer sleeve. The inner sleeve includes an inner sleeve sidewall having an upper end, a lower end, and an outer surface extending therebetween. A base may extend inwardly from the inner sleeve sidewall. The inner sleeve sidewall and the base together defining a receptacle having an opening at the upper end of the inner sleeve. The outer sleeve includes an outer sleeve sidewall having an upper end, a lower end, and an inner surface extending therebetween. The inner sleeve is positioned within the outer sleeve. The lower end of the outer sleeve forms an elongated loop.

According to certain aspects, the inner surface of the outer sleeve sidewall is spaced outwardly from the outer surface of the inner sleeve sidewall. Thus, a sidewall cavity may be formed between the inner sleeve sidewall and the outer sleeve sidewall. The sidewall cavity may extend substantially around the entire circumference of the inner sleeve sidewall.

According to some aspects, a flange extends upwardly from the elongated loop and above the lowermost edge of the inner sleeve. The flange is attached to the inner sleeve. In certain embodiments, the flange may extend upwardly between the inner sleeve and the outer sleeve.

According to other aspects, the elongated loop may be located below the lowermost edge of the inner sleeve. Further, the elongated loop may have a vertical height to width ratio of at least two. An inner rim wall of the elongated loop may extend parallel to an outer rim wall of the elongated loop. Even further, the elongated loop may form a loop cavity, and the loop cavity and the sidewall cavity may be in fluid communication.

According to some aspects, the outer sleeve sidewall may extend parallel to the inner sleeve sidewall. Further, the inner and outer sleeves may both be smooth-walled. According to some embodiments, the inner sleeve may be linearly tapered from its upper end to its lower end. The outer sleeve may be linearly tapered from its upper end to its lower end. Even further, the inner sleeve and the outer sleeve may be formed of paper material.

According to certain aspects, a double-walled container includes an outer sleeve having an outer sleeve sidewall that defines a sidewall taper angle measured from a horizontal supporting surface. The outer sleeve sidewall extends generally parallel to an inner sleeve sidewall provided on an inner sleeve. The double-walled container further includes a base that is recessed upward from a lowermost edge of the outer sleeve. The vertical distance from the lowermost edge of the outer sleeve to an upper surface of the base, measured where the base meets the inner sleeve sidewall, may be greater than a thickness dimension from the outer surface of the outer sleeve sidewall to the inner surface of the inner sleeve sidewall, measured at the base, divided by the cosine of the sidewall taper angle. This feature may facilitate ease of stacking and unstacking of a plurality of cups and further may streamline the manufacturing process.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings.

Figure 1:
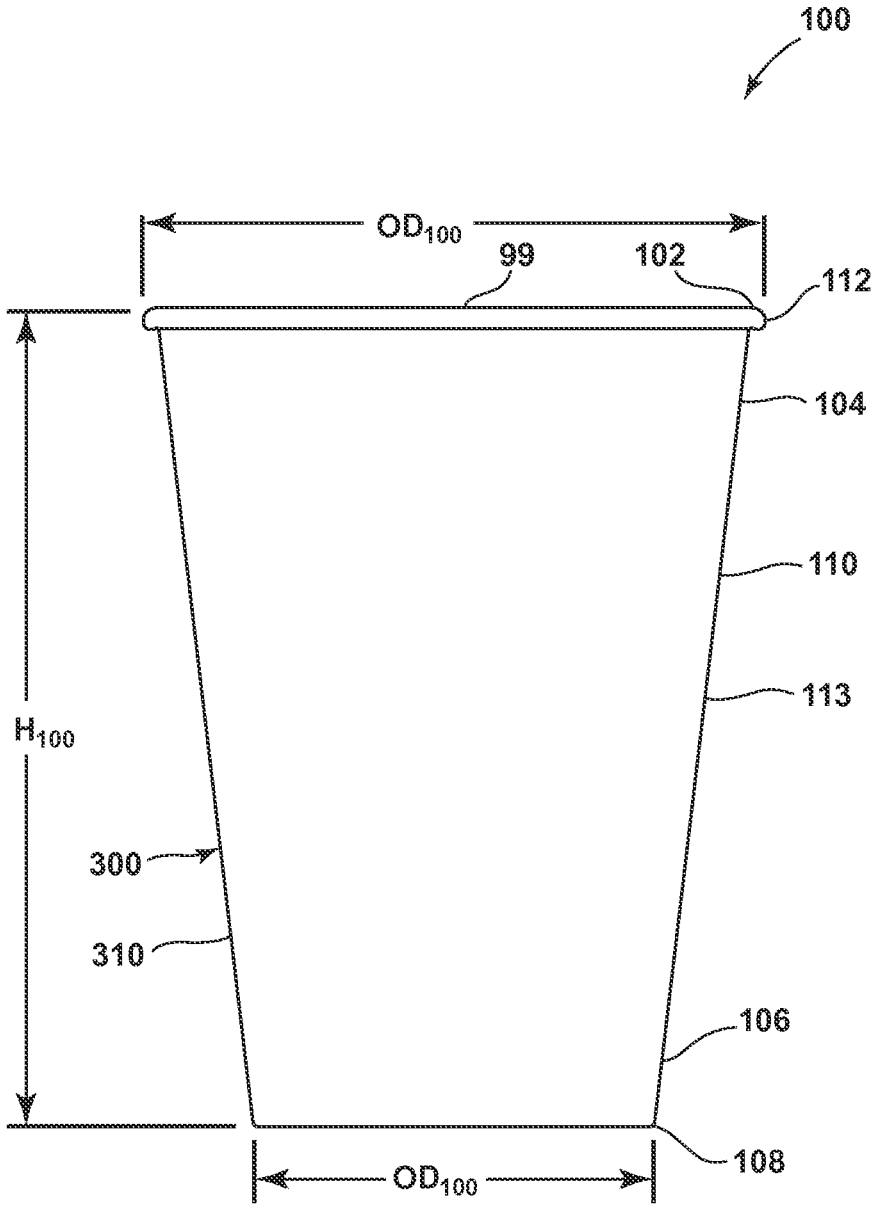
FIG. 1 is a front elevation view of one embodiment of a double-walled container having an inner sleeve and an outer sleeve.

The various figures in this application illustrate examples of double-walled containers and portions thereof according to this invention. The figures referred to above are not necessarily drawn to scale, should be understood to provide a representation of particular embodiments of the invention, and are merely conceptual in nature and illustrative of the principles involved. Some features of the double-walled containers depicted in the drawings may have been enlarged or distorted relative to others to facilitate explanation and understanding. When the same reference number appears in more than one drawing, that reference number is used consistently in this specification and the drawings to refer to similar or identical components and features shown in the various alternative embodiments.

DETAILED DESCRIPTION

Containers described herein are susceptible of embodiments in many different forms. Thus, the embodiments shown in the drawings and described in detail below exemplify the principles of the invention and are not intended to limit the broad aspects of the invention. Particularly, a double-walled container is generally described and shown herein as a cup for containing hot liquid, such as coffee, tea, etc. However, it should be understood that the present invention may take the form of many different types of vessels or containers for holding heated contents, including but not limited to liquids such as beverages, soups, stews, chili, etc. Additionally, a person skilled in the art would readily recognize that the double-walled vessel or container of the present invention may also be used to insulate cold contents, such as an ice-cold beverage.

Figure 2:
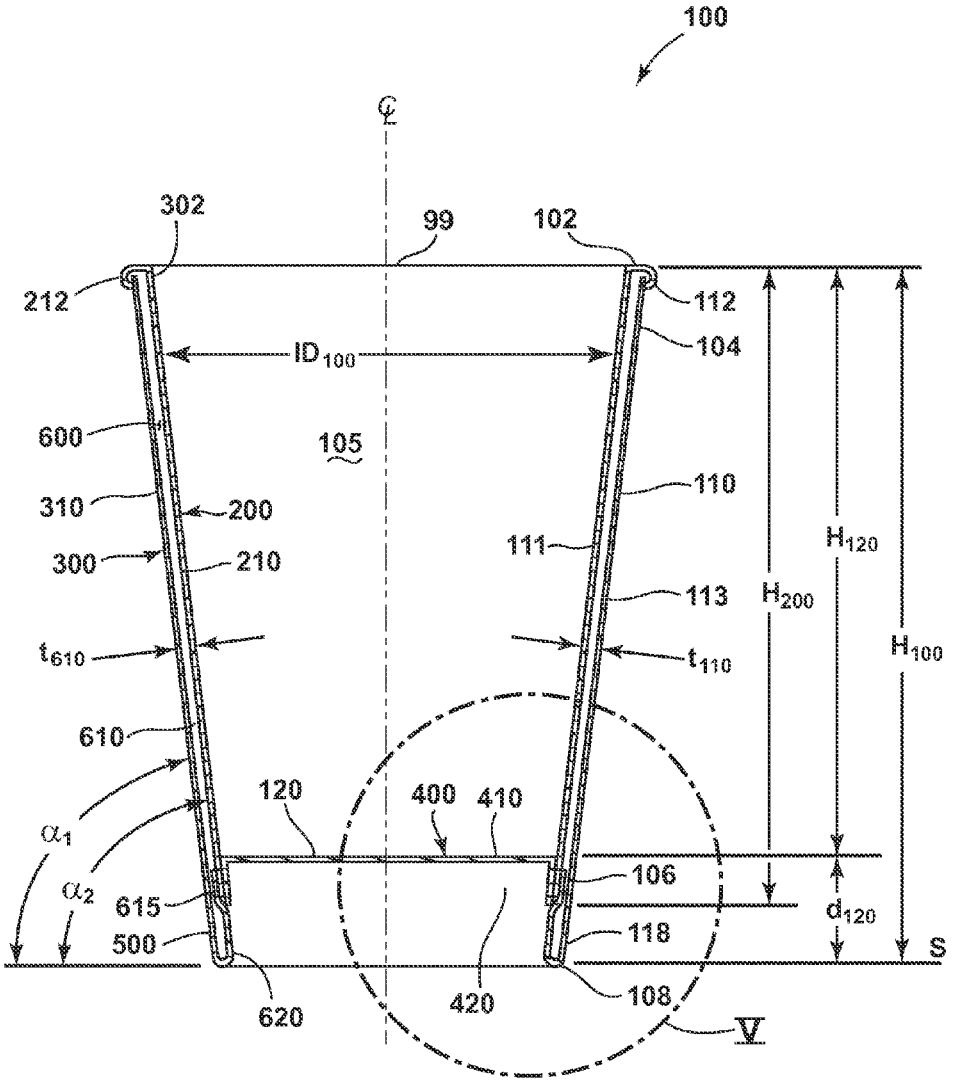
FIG. 2 is a cross-sectional view of the container of FIG. 1.

Referring now in detail to the figures, and initially to FIGS. 1 and 2, there is shown one embodiment of a double-walled vessel or container 100. The container 100 defines an interior volume or container cavity or receptacle 105 (see FIG. 2) for holding beverages or other items placed therein. In addition, the container 100 provides insulation properties.

In this embodiment, container 100 is a cup having a frustoconically configured container sidewall 110. The angled container sidewall 110 has an interior surface 111 and an exterior surface 113 (see FIG. 2). Additionally, the container sidewall 110 has an upper end 104 and a lower end 106. Upper end 104 refers to a region that may encompass, for example, the uppermost 25% of the container 100. Similarly, lower end 106 refers to a region that may encompass, for example, the lowermost 25% of the container 100. Upper end 104 includes an uppermost top edge 102. In this embodiment, uppermost top edge 102 is provided on an upper rim 112 that circumscribes the opening 99 into the receptacle 105. Lower end 106 includes a lowermost bottom edge 108. In this embodiment, lowermost bottom edge 108 is provided on a supporting rim 118 (see FIG. 2).

Container 100 has a receptacle floor 120 for closing off the bottom of the receptacle 105 (see FIG. 2). The receptacle floor 120 is generally positioned in the lower portion of the container 100 and extends inwardly from the interior surface 111 of container sidewall 110 such that the lower end of container 100 (and of receptacle 105) is closed. The receptacle floor 120 may be recessed a vertical distance ($d_{120}$) above the lowermost bottom edge 108 of the container sidewall 110. This distance ($d_{120}$) may be a function of a frustoconical taper angle of the container sidewall 100. A vertical height ($H_{120}$) is defined as the distance from the receptacle floor 120 to the top edge 102 of the container 100.

In this embodiment, the exterior surface 113 of the container sidewall 110 extends in a straight line from the rim 112 to the bottom edge 108. Referring to FIG. 2, the exterior surface 113 is oriented at an angle ($\alpha_1$) to a horizontal supporting surface (S) that is less than 90 degrees, such that the exterior surface 113 diverges from a vertically-oriented centerline (℄) of the container 100 as it extends upward. The interior surface 111 also extends in a straight line from the top edge 102 to the floor 120 and is also oriented at an angle ($\alpha_2$) to the horizontal supporting surface (S) that is less than 90 degrees. Further, as shown in this embodiment, both the exterior surface 113 and the interior surface 111 may be oriented at the same angle ($\alpha=\alpha_1=\alpha_2$). Thus, the container sidewall 110 may be oriented at a taper angle ($\alpha$) that is less than 90° from the horizontal supporting surface (S). The taper angle ($\alpha$) may range from approximately 60° to approximately 90°, from approximately 70° to approximately 90°, or even from approximately 80° to approximately 90°. As one example, when the container is designed to hold beverages, the taper angle ($\alpha$) may range from approximately 82° to approximately 86° to the horizontal supporting surface (S).

Even further, in this particular embodiment, the interior surface 111 and/or the exterior surface 113 may be formed as generally smooth-walled elements. As used herein, the term "smooth-walled" means that the surface or wall does not include any relatively large-scale raised features such as ribs, cusps, ridges, meshes, protuberances, bumps, etc. or relatively large-scale indented features such as channels, dimples, etc. A feature is considered relatively large-scale if it would be provided with specific dimensions and/or a specific location as to that particular individual feature on an engineering drawing. Thus, surface textures, if any, are not considered relatively large-scale features—even if extending over an entire surface and/or even if a relatively rough surface texture—as the individual raised or indented features forming the surface texture would not be specifically dimensioned or located. Further, a sidewall surface may include one or more seams and/or overlapped regions due to manufacturing processes and still be considered a generally smooth-walled surface.

Referring to FIG. 1, the container 100 has a vertical height ($H_{100}$) extending from the top edge 102 to the bottom edge 108. Generally, the sidewall 110 of the container 100 has an outside diameter ($OD_{100}$) (see FIG. 1) and an inside diameter ($ID_{100}$) (see FIG. 2). As explained above, the container sidewall 110 may be generally sloping or frustoconical in shape. In the example embodiment of FIGS. 1 and 2, the outside diameter ($OD_{100}$) of the container 100 decreases from the top edge 102 to the bottom edge 108 (see FIG. 1) and the inside diameter ($ID_{100}$) of the container 100 decreases from the top edge 102 to the receptacle floor 120 (see FIG. 2). Optionally, the sidewall 110 need not be frustoconical. For example (not shown), when viewed from the side, the sidewall 110 cross-section may be formed with curved walls, with bi-linear walls, with stepped walls, with multi-tapered walls, with variably tapered walls etc. extending from the upper end 104 to the lower end 106. Additionally, when viewed from above (not shown), a cross-section of the frustoconical sidewall 110 is circular. However, in general, the sidewall 110 need not be frustoconical and the cross-sectional shape, when viewed from above, need not be circular. For example, the sidewall 110 may have an elliptical, oval, triangular, rectangular, hexagonal, etc. cross-section.

According to aspects of the invention, and as best shown in FIG. 2, the container 100 includes an inner sleeve 200, an outer sleeve 300, and a base element 400. Outer sleeve 300 forms a supporting rim 500 at its lower end. Further, outer sleeve 300 is positioned around inner sleeve 200 and spaced therefrom by a cavity 600.

Figure 3:
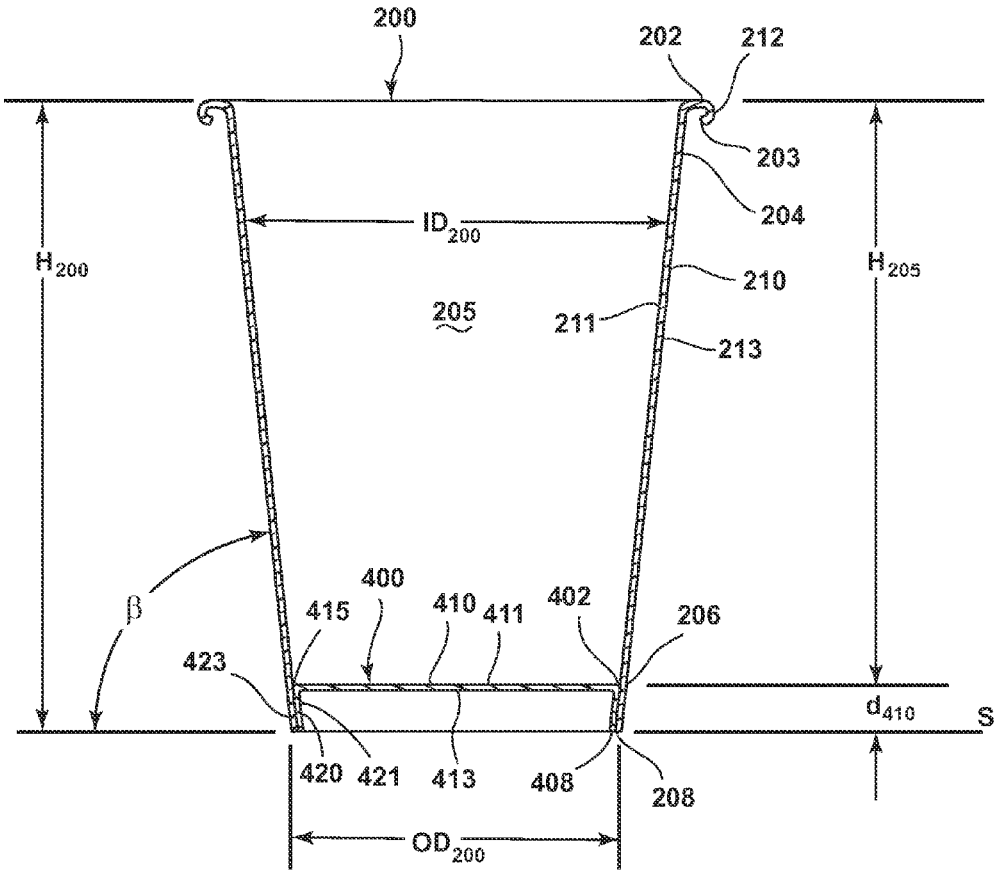
FIG. 3 is a cross-sectional view of the inner sleeve and base according to the embodiment of FIG. 1.

The Inner Sleeve 200:

A variety of inner sleeves 200 may be utilized with various outer sleeves 300 to form the overall container 100. Referring to FIG. 2 and also to FIG. 3, the inner sleeve 200 in conjunction with the base 400 may generally provide a vessel for holding the heated or cooled food/beverage or other item(s) placed in the container 100. The inner sleeve 200 has an inner sleeve sidewall 210 defining, at least in part, an inner sleeve volume or receptacle 205 (FIG. 3). Referring also to FIG. 2, in the finished container 100, the inner sleeve volume 205 may be coextensive with the container interior volume 105. The inner sleeve 200 may be formed with seams or it may be a seamless component.

Referring specifically to FIG. 3, the inner sleeve sidewall 210 has an inner surface 211 and an outer surface 213. The inner surface 211 and/or the outer surface 213 may be formed as generally smooth-walled elements. Referring also to FIG. 2, the inner surface 211 of the inner sleeve sidewall 210 may form the interior surface 111 of the container 100.

Additionally, as shown in FIG. 3, the inner sleeve sidewall 210 has an upper end 204 and a lower end 206 opposed to upper end 204. Upper end 204 refers to a region that may encompass, for example, the uppermost 25% of the sidewall 210. Similarly, lower end 106 refers to a region that may encompass, for example, the lowermost 25% of the sidewall 210. Upper end 204 includes an uppermost edge 202. In some embodiments, referring also to FIG. 2, the uppermost edge 202 of the inner sleeve 200 may be coincident with the uppermost edge 102 of the container 100. Further, for example as best shown in FIG. 3, the upper end 204 of inner sleeve sidewall 210 may be outwardly rolled over and an upper rim 212 may be formed. Referring also to FIG. 2, it can be seen that the upper rim 212 of the inner sleeve sidewall 210 may form the upper rim 112 of the container 100. Further referring again to FIG. 3, the perimeter edge 203 of sidewall 210 is rolled over such that the perimeter edge 203 does not form the "uppermost" feature of sidewall 210 or of container 100.

The lower end 206 of the inner sleeve sidewall 210 includes a lowermost end 208. The lowermost end 208 forms the "lowermost" feature of inner sleeve 200. Thus, for example, in certain embodiments such as shown in FIG. 3, the lowermost end 208 may coincide with the lower edge of the inner sleeve 200 and may be aligned or approximately aligned with a lowermost end 408 of the base element 400. In other embodiments (not shown), the edge of inner sleeve sidewall 210 may be inwardly turned, folded or rolled under (when, for example, inner sleeve 200 is joined to base 400) such that the lowermost end 208 is not coincident with the edge.

In the embodiment of FIG. 3, the inner sleeve sidewall 210 of the inner sleeve 200 is generally linearly angled or sloped such that the inner sleeve sidewall is frustoconical in shape. The inner sleeve sidewall 210 may be oriented at a taper angle ($\beta$) that is greater than 90° from a horizontal supporting surface (S). The taper angle ($\beta$) may range from approximately 60° to approximately 90°, from approximately 70° to approximately 90°, from approximately 80° to approximately 90°, even for example, when the container is used to hold beverages, from approximately 82° to approximately 82° to the horizontal supporting surface (S). A person of ordinary skill in the art, given the benefit of this disclosure, would understand that the taper angle ($\alpha_1$) of the inner surface 111 of the container 100 for the embodiment of FIGS. 1-3 would be coincident with the taper angle ($\beta$) of the inner sleeve sidewall 210. In one non-limiting example, for a 20 oz. beverage container 100, the inner sleeve taper angle ($\beta$) may be approximately 85° 11' with respect to a horizontal supporting surface (S) or approximately 94° 49' with respect to the centerline (℄) of the container 100. In another non-limiting example, for a 20 oz. beverage container 100, the inner sleeve taper angle ($\beta$) may be approximately 83° 06' with respect to a horizontal supporting surface (S) or approximately 96° 54' with respect to the centerline (℄) of the container 100.

Still referring to FIG. 3, the sidewall 210 of the inner sleeve 200 has an inside diameter ($ID_{200}$) and an outside diameter ($OD_{200}$). As explained above, the sidewall 210 of the inner sleeve 200 may be generally frustoconical in shape. Accordingly, the inside diameter ($ID_{200}$) and the outside diameter ($OD_{200}$) of the inner sleeve 200 may decrease linearly from the upper end 204 to the lower end 206 of the inner sleeve 200. Optionally, the sidewall 210 need not be frustoconical. For example (not shown), when viewed from the side, the sidewall 210 cross-section may be formed with curved walls, with bi-linear walls, with stepped walls, with multi-tapered walls, with variably tapered walls etc. extending from the upper end 204 to the lower end 206. Additionally, when viewed from above (not shown), a cross-section of the frustoconical sidewall 210 is circular. However, in general the sidewall 210 need not be frustoconical and the cross-sectional shape, when viewed from above, need not be circular. For example, the sidewall 210 may have an elliptical, oval, triangular, rectangular, hexagonal, etc. cross-section.

The inner sleeve 200 has a vertical height ($H_{200}$). In the embodiment shown in FIGS. 1-3, the height ($H_{200}$) of the inner sleeve 200 is less than the vertical height ($H_{100}$) of the container 100.

Even further, in this particular embodiment, the interior surface 211 and/or the exterior surface 213 are formed as generally smooth-walled elements. Forming the interior and exterior surfaces 211, 213 with generally smooth walls may be desirable as it may reduce manufacturing and/or material costs. Alternatively, the sidewall 210 of the inner sleeve 200 need not be formed with substantially smooth walls. Rather, for example, the inner sleeve 200 may include stiffening elements or standoff members (not shown). For example, spacing elements such as ribs, ridges, knobs, etc., whether vertical, horizontal, angled, continuous or discontinuous, etc. may be provided on the outer surface 213 of the inner sleeve sidewall 210 to assist in the maintenance of a gap 610 (see FIG. 2) between the inner sleeve sidewall 210 and the outer sleeve sidewall 310. Further, the stiffening element such as ribs, ridges, doublers, protrusions, etc. may increase the rigidity of the inner sleeve sidewall 210 and thus of the container sidewall 110. The stiffening elements may be formed in any suitable manner with any suitable material. For example, it is contemplated that the stiffening elements may be in the form of beads or vertical or horizontal lines of acrylic or other plastic material, hot melt, foamed synthetic or natural-based material, adhesive, cork, natural fibers or other insulating materials printed, sprayed, laminated or extruded onto the inner sleeve 200. Stiffening elements made from materials having adhesive bonding properties, such as hot melts or other adhesives, may provide the additional benefit of bonding the outer sleeve 300 to the inner sleeve 200. It is understood that the geometry and positioning of the stiffening elements, spacing elements, or other standoff members may be varied without departing from the scope of the present invention. Thus, the stiffening elements or standoffs members may be presented in an organized or randomly spaced arrangement. For example, stiffening and/or spacing elements may be provided on the lower half of the sidewall 210, but not on the upper half. The stiffening and/or spacing elements may be configured to extend completely or only partially across the gap 610 of cavity 600 between inner sleeve sidewall 210 and the outer sleeve sidewall 310. If extending only partially across the gap 610, the spacing elements would allow the sidewalls 210, 310 to approach one another, thereby decreasing the gap 610, prior to the spacing elements coming into contact with the opposing wall.

Various upper rim configurations, as would be apparent to persons of ordinary skill in the art given the benefit of this disclosure, may be provided at the upper end 104 of the container 100. For example, as shown in FIG. 3, in a preferred embodiment the inner sleeve 200 includes an upper or top rim or lip 212 formed as an outwardly rolled portion of the upper end 204 of the inner sleeve sidewall 210. Other rim configurations may be provided without deviating from the scope of the invention. Alternative embodiments (not shown) are also possible wherein the perimeter edge 203 of sidewall 210 is not rolled over to form a rim, but rather itself forms the uppermost end of sidewall 210. In such instance, a bead or other edge treatment may be used to finish the perimeter edge 203.

According to certain embodiments, the inner sleeve 200 may be made of a one-piece construction, as would be apparent to persons of ordinary skill in the art given the benefit of this disclosure. As such, the inner sleeve sidewall 210 may be formed as a single flat blank (not shown) that may be folded or rolled to form a three-dimensional shape. One or more seams may be created when the three-dimensional shape is formed. It is understood, however, that alternatively the inner sleeve 200 may be made of multiple subcomponents subsequently joined together.

Base Element 400:

Referring to FIGS. 2 and 3, a base element 400 is provided to the lower boundary or receptacle floor 120 of the container receptacle 105. The base element 400 extends across and is attached to the lower end 206 of the inner sleeve 200. According to a preferred embodiment, the container 100 has a single base element 400 and does not include a second base element.

Thus according to certain embodiments and referring to FIG. 3, the base element 400 includes a bottom wall 410 and a skirt 420. The bottom wall 410, which is substantially horizontally oriented, includes an upper surface 411 and a lower surface 413. The bottom wall may be joined to the inner surface 211 of the sidewall 210 at a peripheral edge 415. The bottom wall 410 may be substantially flat, slightly domed or even slightly concave.

As shown in FIG. 3, the skirt 420 extends downward from peripheral edge 415 at an angle generally parallel to the taper angle ($\beta$) of the inner sleeve 200. In other embodiments (not shown), the skirt 420 may extend upward from peripheral edge 415 at an angle generally parallel to the taper angle ($\beta$) of the inner sleeve 200. Skirt 420 includes an uppermost end 402 and a lowermost end 408. Skirt 420 further includes an inner surface 421 and an outer surface 423.

The outwardly facing surface 423 of the skirt 420 may be joined to the inner surface 211 of sidewall 210. In the embodiment of FIG. 3, the lowermost end 208 of the inner sleeve 200 is generally horizontally aligned with the lowermost end 408 of the skirt 420. In other embodiments (see, e.g., FIG. 6), the lowermost end 208 (and the lower end 206) of the inner sleeve 200 may be folded upward and inward. The folded portion of the lower end 206 of the inner sleeve 200 may wrap around the lowermost end 408 of the skirt 420 such that the lower end 206 of inner sleeve 200 may be bonded to both the inner and the outer surfaces 421, 423 of the skirt 420. Other methods of attaching the inner sleeve 200 to the base element 400 may be used without departing from the invention.

In a preferred embodiment and as shown in FIG. 3, the generally horizontal bottom wall 410 of base element 400 is spaced a vertical distance ($d_{410}$) above the lowermost end 208 of the inner sleeve 200. This lowermost end 208 may be formed by the lower edge of the inner sleeve 200 as shown in FIG. 3 or it may be formed by a bottom edge formed if the inner sleeve 200 includes a folded portion (not shown) at the lower end 206. This vertical offset or upward recessing of the bottom wall 410 means that the vertical distance or height ($H_{205}$) of the inner sleeve sidewall 210 from the top edge 102 to the bottom wall 410 may be less than the vertical distance of the inner sleeve sidewall 210 from the top edge 102 to the lowermost edge (i.e., either lowermost end 208 or bottom edge 218). In the embodiment of FIGS. 1-3 this height ($H_{205}$) also corresponds to a vertical dimension of the receptacle 205 and a vertical dimension of the receptacle 105.

Alternatively, for certain embodiments (not shown), the bottom wall 410 of the base element 400 may extend in the same horizontal plane as the lowermost end 208 of the inner sleeve 200. A lower portion of the inner sleeve sidewall 210 may be folded inwardly and connected to the lower surface 413 of the bottom wall 410. Optionally, an upwardly extending skirt 420 (not shown) of base 400 may be attached to the inner surface 211 of the inner sleeve 200. Further, optionally, the base 400 need not include a skirt. Accordingly, it is understood that the formation of the connection between the inner sleeve 200 and the base 400 may be accomplished in a variety of methods without departing from the scope of the present invention.

Figure 4A:
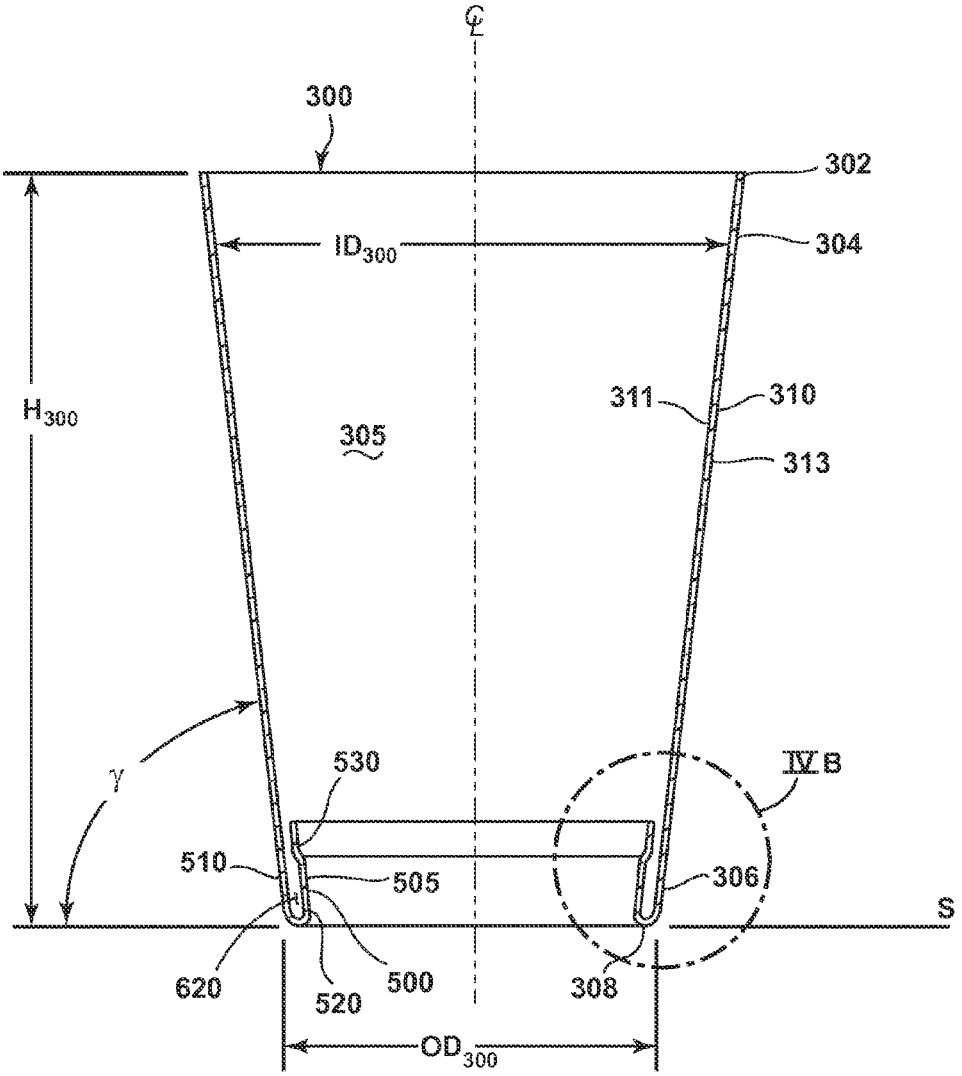
FIG. 4A is a cross-sectional view of the outer sleeve according to the embodiment of FIG. 1.
Figure 4B:
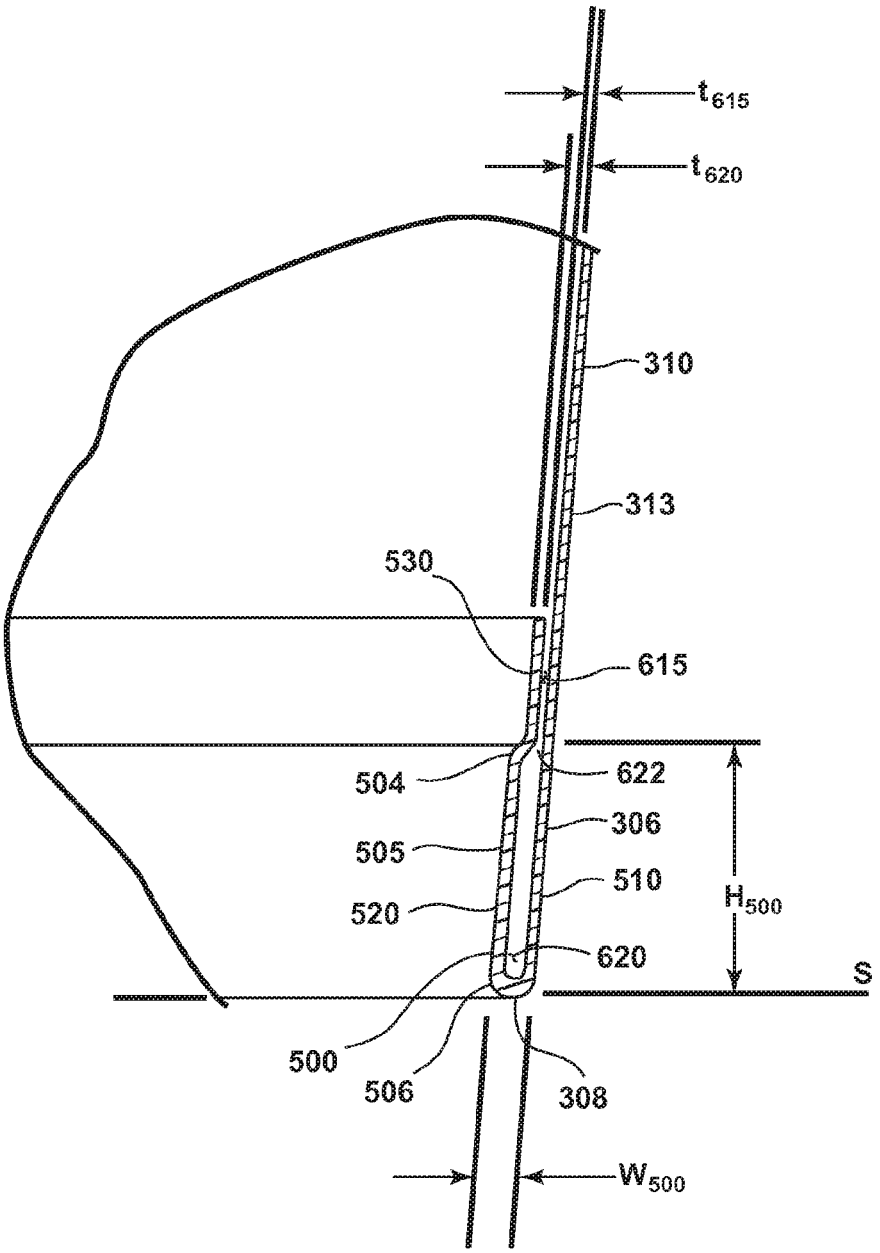
FIG. 4B is a cross-sectional view of the detail, as identified in FIG. 4A, of the outer sleeve according to the embodiment of FIG. 1.

The Outer Sleeve 300:

In one embodiment, as shown in FIGS. 4A and 4B, and similar to the inner sleeve 200 described above, the outer sleeve 300 may include a frustoconically configured outer sleeve sidewall 310 defining an interior volume 305. The outer sleeve sidewall 310 has an inner surface 311 and an outer surface 313. The outer surface 313 of the outer sleeve sidewall 310 forms the exterior surface 113 of the container 100. Additionally, the outer sleeve sidewall 310 has an upper end 304 and a lower end 306 opposed to upper end 304. Upper and lower ends 304, 306 generally refer to regions that encompass, respectively, the uppermost and lowermost 25% of the sidewall 310. Upper end 304 includes an upper edge 302. Lower end 306 includes a lower edge 308.

As with the inner sleeve 200, the inner surface 311 and/or the outer surface 313 of the sidewall 310 of the outer sleeve 300 may be formed as generally smooth-walled elements. Further, the outer sleeve 300 may be formed with seams or it may be a seamless component.

In the embodiment of FIG. 4A, the outer sleeve sidewall 310 of the outer sleeve 300 is generally linearly angled or sloped such that the outer sleeve sidewall is frustoconical in shape. The outer sleeve sidewall 310 may be oriented at a taper angle ($\gamma$) that is less than 90° from a horizontal supporting surface (S). The taper angle ($\gamma$) may range from approximately 60° to approximately 90°, from approximately 70° to approximately 90°, from approximately 80° to approximately 90°, or even from approximately 82° to approximately 86° to the horizontal supporting surface (S).

Generally, the sidewall 310 of the outer sleeve 300 has an inside diameter ($ID_{300}$) and an outside diameter ($OD_{300}$). According to certain preferred embodiments, the sidewall 310 of the outer sleeve 300 is generally sloping or frustoconical in shape. Accordingly, the inside diameter ($ID_{300}$) and the outside diameter ($OD_{300}$) of the outer sleeve 300 decrease linearly from the upper end 304 to the lower end 306 of the outer sleeve 300. Even further, the outside diameter ($OD_{300}$) of the outer sleeve 300 may decrease linearly from the upper edge 302 to the lower edge 308 of the outer sleeve 300. Optionally, the sidewall 310 need not be frustoconical. For example (not shown), when view from the side, the sidewall 310 cross-section may be formed with curved walls, with bi-linear walls, with stepped walls, with multi-tapered walls, with variably tapered walls etc. extending from the upper end 304 to the lower end 306. Additionally, when viewed from above (not shown), a cross-section of the frustoconical sidewall 310 is circular. However, in general the sidewall 310 need not be frustoconical and the cross-sectional shape, when viewed from above, need not be circular. For example, the sidewall 310 may have an elliptical, oval, triangular, rectangular, hexagonal, etc. cross-section.

Additionally, in the embodiment shown in FIGS. 1-4A, the sidewall taper angle (γ) of the outer sleeve 300 may be substantially identical to the sidewall taper angle (β) of the inner sleeve 200. Due to manufacturing constraints and design tolerances, however, the sidewall taper angle (γ) of the outer sleeve 300 may not be exactly identical to the sidewall taper angle (β) of the inner sleeve 200 and may vary by up to a tenth of a degree, for example.

As shown in FIGS. 1-2 and 4A, the sidewall 310 is formed as a substantially smooth wall. Alternatively, the sidewall 310 of the outer sleeve 300 need not be formed as a substantially smooth wall. Rather, for example, similar to the outer surface 213 of the inner sleeve described above, the sidewall 310 may include stiffening elements and/or standoff members (not shown). Thus, ribs, ridges, knobs, or other protrusions, etc., whether vertical, horizontal, angled, continuous or discontinuous, etc. may be provided on the inner surface 311 or the outer surface 313 to assist in maintaining the stability and/or rigidity of the sidewall 310 and/or on the inner surface 311 to assist in maintaining a gap 610 between the inner sleeve sidewall 210 and the outer sleeve sidewall 310. The stiffening elements may be formed in any suitable manner with any suitable material. For example, it is contemplated that the stiffening elements may be in the form of beads or vertical or horizontal lines of acrylic or other plastic material, hot melt, foamed synthetic or natural-based material, adhesive, cork, natural fibers or other insulating materials printed, sprayed, laminated or extruded onto the outer sleeve 300. Stiffening elements made from materials having adhesive bonding properties, such as hot melts or other adhesives, may be beads of adhesive and/or foam, which provide the additional benefit of bonding the outer sleeve 300 to the inner sleeve 200. The stiffening and/or spacing elements may be configured to extend completely or only partially across the gap 610 between the inner sleeve sidewall 210 and the outer sleeve sidewall 310. If extending only partially across the gap 610, the spacing elements would allow the sidewalls 210, 310 to approach one another, thereby decreasing the gap 610, prior to the spacing elements coming into contact with the opposing wall.

Further, the outer sleeve 300 may or may not have an upper or top rim associated therewith. In the embodiments shown in FIGS. 1-4, the outer sleeve 300 terminates at the upper edge 302 of the outer sleeve sidewall 310 and has no curled or rolled rim extending therefrom. In alternative embodiments (not shown), the outer sleeve 300 may have an inwardly or outwardly curved or bent top rim formed at the upper end 304 of the outer sleeve sidewall 310 of the outer sleeve 300.

As best shown in FIGS. 4A and 4B, the lower end 304 of the outer sleeve 300 includes a supporting rim 500. Supporting rim 500 may extend circumferentially around the centerline (℄) and form the supporting rim of container 100. Supporting rim 500 is preferably formed as a vertically elongated loop 505 extending below the lowermost edge 208 of inner sleeve 200. Specifically, in this embodiment, the lower end 306 of the outer sleeve 300 is folded or turned radially inward (i.e., toward the centerline) and then folded or turned upward. The elongated loop 505 defines and extends between an upper loop end 504 and a lower loop end 506. In this embodiment, upper loop end 504, which is located below the lowermost edge 208 of inner sleeve 200, is open and the loop 505 is an open loop, not a closed loop. In other embodiments (not shown), the elongated loop 505 may be formed as a closed loop.

The elongated loop 505 includes an exterior or outer rim wall 510 and an interior or inner rim wall 520 with the lower loop end 506 extending therebetween. Outer rim wall 510 is essentially a continuation of outer sleeve sidewall 310. In this particular embodiment, the outer rim wall 510 has the same taper angle (γ) as the outer sleeve sidewall 300 and there is no visual demarcation between the sidewall 310 and the rim wall 510. In other embodiments (not shown), the outer rim wall 510 need not have the same taper angle (γ) as the outer sleeve sidewall 310. As another example, in even other embodiments (not shown), a circumferentially extending indentation or bead may demarcate a boundary between a portion of the sidewall 310 above the supporting rim 500 and that portion of the sidewall 310 forming the supporting rim (e.g., the outer rim wall 510). Such an indentation or bead (continuous or discontinuous) may form a stiffening element, a spacing element and/or may be formed as an auxiliary artifact of the manufacturing process.

Referring to FIG. 4B, the elongated loop 505 of the supporting rim 500 has a vertical height ($H_{500}$). The vertical height of the elongated loop 505 may be measured from the horizontal supporting surface (S) to the upper end 504 of the elongated loop 505. As further described below, the upper end 504 of the elongated loop 505 may generally coincide with the lowermost end 208 of the inner sleeve 200 and/or the lowermost end 408 of the base element 400. According to some embodiments, for example when the container 100 is designed to accommodate from approximately 8 to approximately 26 ounces of beverage, the vertical height ($H_{500}$) of the elongated loop 505 may range from approximately 0.25 in (6.35 mm) to approximately 0.55 in (14.0 mm). A vertical height ($H_{500}$) ranging from approximately 0.30 in (7.6 mm) to approximately 0.45 in (11.4 mm) may be preferred, particularly when the taper angle (γ) of the outer sleeve sidewall 310 ranges from approximately 82° to approximately 86°.

Further, the elongated loop 505 has a width ($W_{500}$). This width is generally measured as an exterior dimension oriented perpendicular to the outer surface 313 of the outer sleeve 310 in the vicinity of the supporting rim 500. In other words, this thickness is generally measured perpendicular to the exterior rim wall 510, and need not be horizontally oriented. The width is measured between the outermost surface and the innermost surface of the elongated loop. According to some embodiments, for example when the container 100 is designed to accommodate from approximately 8 to approximately 26 ounces of beverage, the width ($W_{500}$) of the elongated loop 505 may range from approximately 0.05 in (1.25 mm) to approximately 0.10 in (2.50 mm). A width ($W_{500}$) ranging from approximately 0.06 in (1.50 mm) to approximately 0.08 in (2.03 mm) may be preferred, particularly when the taper angle (γ) of the outer sleeve sidewall 310 ranges from approximately 82° to approximately 86°.

The elongated loop 505 of supporting rim 500 may have a vertical height-to-width ratio ($R=H_{500}/W_{500}$) that is greater than 2. Further, the elongated loop 505 may have a height-to-width ratio (R) that is less than 10. According to some embodiments, for example when the container 100 is designed to accommodate from approximately 8 to approximately 26 ounces of beverage, the height-to-width ratio (R) of the elongated loop 505 may range from approximately 4 to approximately 7 or even from approximately 4.5 to approximately 7.5.

According to the embodiment shown in FIGS. 4A-4B, the inner rim wall 520 is spaced inwardly from outer rim wall 510. Further, in this embodiment, the inner rim wall 520 extends parallel to the outer rim wall 510, and thus is also oriented at the same taper angle (γ) as the outer sleeve sidewall 310. In this embodiment, the width ($W_{500}$) of the elongated loop 505 is generally constant. In other embodiments (not shown), the inner rim wall 520 need not be parallel to the outer rim wall 510. For example, the inner rim wall 520 may extend upward and inward relative to the outer rim wall 510 such that the elongated loop 505 is wider at the top than at the bottom. As another example, the inner rim wall 520 may extend upward and outward relative to the outer rim wall 510 such that the elongated loop is wider at the bottom than at the top. In even other embodiments (not shown), the inner rim wall 520 may bow or curve in toward the centerline, may bow or curve outward toward the outer rim wall 510, may have an "S-shape" curve, a stepped profile, etc.

Lower rim end 506, which connects the outer rim wall 510 and the inner rim wall 520 at their lower ends, may be formed with a smooth, generally rounded, curvature (much like the end of a paperclip). In other embodiments (not shown), the lower rim end 506 may be squared off, chamfered, pointed, splayed, etc., rather than rounded. The lower rim end 506 provides the lowermost edge 308 of the outer sleeve 300 and also the lowermost or bottom edge 108 of the container 100.

In the embodiment of FIGS. 4A and 4B, the upper end of the inner rim wall 520 curves or bends outwardly (i.e., away from the container centerline) back toward the upper end of the outer rim wall 510, as if the loop were to be closed at its upper end 504. However, in this particular embodiment, the curved portion at the upper end of the inner rim wall 520 stops short and does not contact the outer rim wall 510 and, thus, does not close the loop 505. As shown in FIG. 4B, a gap 622 may exist between the inner rim wall 520 and the outer rim wall 510 at the upper end 504 of the loop 505. In other embodiments (not shown), the inner rim wall 520 and the outer rim wall 510 may abut one another at the upper end 504 of the elongated loop 505. In certain embodiments, the abutting inner rim wall 520 and the outer rim wall 510 may contact one another at the upper end 504, while not being affixed to one another. In other embodiments, the inner rim wall 520 and the outer rim wall 510 may be affixed to one another at the upper end 504 of the loop 505. In any event, whether the elongated loop 505 is completely closed or only substantially closed, the loop 505 may be considered to define and at least substantially enclose a loop cavity 620.

Loop cavity 620 is defined as a volume located below the lowermost edges 208, 408 of the inner sleeve 200 and the base element 400. Further, the loop cavity 620 is located between the inner rim wall 520 and the outer rim wall 510. In a preferred embodiment, the loop cavity 620 is devoid of any internal structure and is filled with air. According to another preferred embodiment, the loop cavity 620 extends continuously along the circumference of the supporting rim 500.

Further, in the embodiment of FIGS. 4A and 4B, the outer sleeve 300 is provided with a loop flange 530 extending upwardly from the upper edge of the inner rim wall 520. Thus, in certain embodiments, for purposes of measuring the vertical height ($H_{500}$) of the elongated loop 505, the top of the elongated loop 505 may coincide with the bottom of the loop flange 530. Flange 530 extends circumferentially (continuously or discontinuously) along the upper edge of the rim wall 520. Flange 530 extends generally parallel to the inner surface 311 of outer sleeve 300. A cavity 615 (see FIG. 4B) may be provided between flange 530 and the outer sleeve sidewall 310. The cavity 615 may form a portion of the cavity 600 and/or the cavity 620 and may connect the cavities 600, 620.

In the embodiment of FIG. 4B, the inner rim wall 520 curves outwardly at its top end, toward the outer rim wall 510. Thus, loop flange 530 is located closer than the inner rim wall 520 to the outer sleeve sidewall 310. In other words, in this embodiment, the thickness ($t_{615}$) of the cavity 615 is less than the thickness ($t_{620}$) of the cavity 620. In other example embodiments (not shown), the upper end of the inner rim wall 520 may extend further away from the outer rim wall 510. Thus, loop flange 530 may be located farther than the inner rim wall 520 from the outer sleeve sidewall 310 and the thickness ($t_{615}$) of the cavity 615 may be greater than or equal to the thickness ($t_{620}$) of the cavity 620.

The Double-Walled Container 100:

In one embodiment, such as that shown in FIGS. 1-5, to create the container 100 an inner sleeve 200 and an outer sleeve 300 are separately formed, and the inner sleeve 200 is placed in the outer sleeve 300. In a preferred embodiment, the inner sleeve 200 may be affixed to the base element 400 prior to the insertion of the inner sleeve 200 into the outer sleeve 300.

Upon insertion of the inner sleeve 200 into the outer sleeve 300 the gap 610 is formed between the inner and outer sleeve sidewalls 210, 310. The gap 610 extends circumferentially between the sidewalls 210, 310 of the container 100. As shown in FIG. 2, substantially the entire height ($H_{200}$) of the sidewall 210 of the inner sleeve 200 may be spaced from the outer sleeve sidewall 310. Thus, for the entire height ($H_{105}$) of the receptacle 105, the inner and outer sleeves 200, 300 are spaced apart. Even further, as also shown in FIG. 2, the sidewall 310 of the outer sleeve 300 may be spaced from the inner sleeve sidewall 210, the base element 400, and the inner rim wall 520. The gap 610 may form a cavity that is defined between the sidewall 210 and the sidewall 310. The cavity 615 is defined between the loop flange 530 and the sidewall 310. The cavity 620 is defined between the inner rim wall 520 and the sidewall 310 (and thus, also, between the inner rim wall 520 and the outer rim wall 510). Cavity 600 may include gap 610, cavity 615 and cavity 620. For example, as shown in FIG. 2, all three of the gap 610 and cavities 615 and 620 are in fluid communication with one another. Thus, according to this embodiment, the cavity 600 extends along the entire height ($H_{100}$) of the container 100. In other embodiments (not shown), loop flange 530 may block fluid communication between cavity 600 and cavity 620. Thus, for this embodiment, cavity 600 may include cavity formed by gap 610, but not cavity 620.

As illustrated in the embodiment of FIGS. 1-5, the outer surface 213 of inner sleeve 200 and the inner surface 311 of outer sleeve 300 are formed with smooth walls. As such, the cavity 600 is devoid of any stiffening or spacing elements spanning or extending into the gap 610 between the sidewalls 210, 310. This smooth-walled embodiment may be advantageous due to its simplicity, both from a material and manufacturing standpoint.

Further, as shown in FIG. 2, outer sleeve 300 is positioned around inner sleeve 200. As such, referring also to FIGS. 3 and 4A, the inside diameter ($ID_{300}$) of the outer sleeve 300 is greater than or equal to the outside diameter ($OD_{200}$) of the inner sleeve 200. In some embodiments, the difference between the inside diameter ($ID_{300}$) and the outside diameter ($OD_{200}$) may range up to approximately 0.060 inches (1.52 mm). In other embodiments, the difference between the inside diameter ($ID_{300}$) and the outside diameter ($OD_{200}$) may range from approximately 0.001 inches (0.025 mm) to approximately 0.050 inches (1.27 mm), from approximately 0.010 inches (0.25 mm) to approximately 0.050 inches (1.27 mm), or even from approximately 0.020 inches (0.50 mm) to approximately 0.040 inches (1.00 mm). The difference between the inside diameter ($ID_{300}$) and the outside diameter ($OD_{200}$) may vary (increasing and/or decreasing) as a function of the vertical distance from the top or bottom edges 102, 108 of the container 100 and/or as a function of a circumferential position around the centerline (℄) of the container 100.

When the outer sleeve 300 is positioned around the inner sleeve 200, because the inside diameter ($ID_{300}$) of the outer sleeve 300 is greater than the outside diameter ($OD_{200}$) of the inner sleeve 200, the gap 610 is formed between the inner sleeve sidewall 210 and the outer sleeve sidewall 310. When the sidewall taper angle (γ) of the outer sleeve 300 is equal to the sidewall taper angle (β) of the inner sleeve 200, a gap 610 having a constant thickness is formed between the inner sleeve sidewall 210 and the outer sleeve sidewall 310. Specifically, the gap 610 extends between the outer surface 213 of the inner sleeve sidewall 210 and the inner surface 311 of the outer sleeve sidewall 310. Further, the gap 610 may extend from the upper end 204 of the inner sleeve sidewall 210 to the lower end of the inner sleeve sidewall 210. Even further, the gap 610 may extend all the way around the circumference of the sidewall 110 of the container 100.

In a preferred embodiment, the cavities 600, 615, 620 contain air, which provide thermal insulation properties. Even further, in a preferred embodiment, the air in the cavity 600 defined between the inner and outer sleeve sidewalls 210, 310 is in fluid communication with the air in the cavity 620 defined within the elongated loop 505. In other embodiments, one or more of the cavities 600, 615, 620 may be filled with any material having suitable insulating properties. For example, cavity 620 may be filled with a foamed thermoplastic.

Figure 5:
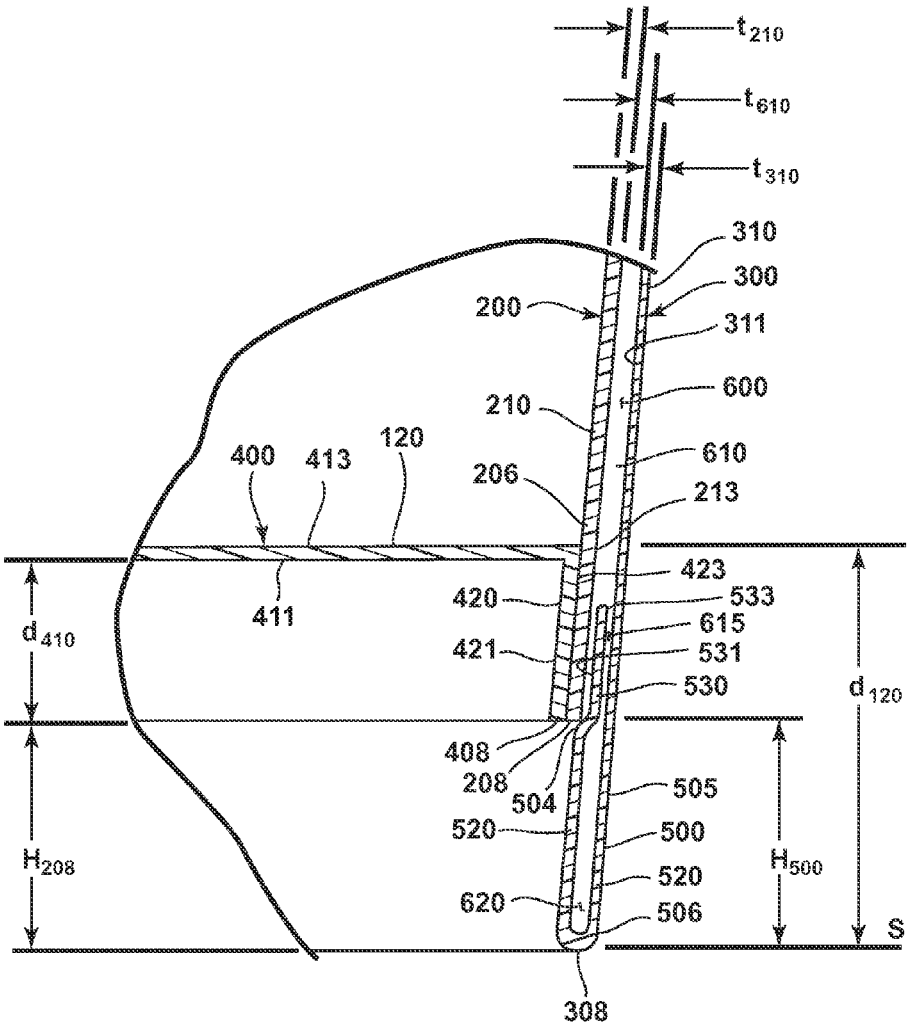
FIG. 5 is a cross-sectional view of the detail, as identified in FIG. 2, of the container of FIG. 1.

Cavity 600 may have substantially constant gap spacing. The shortest distance between the outer surface 213 and the inner surface 311 defines the thickness ($t_{610}$) of the gap 610 of cavity 600. Referring to FIGS. 2 and 5, the thickness ($t_{610}$) of this gap spacing is generally measured perpendicular to the outer surface 113 of the container sleeve 110 in the vicinity of the gap 610. In one preferred embodiment, which may be especially applicable for containers designed to hold approximately 8 to 26 ounces of a beverage, the thickness ($t_{610}$) of the gap 610 may be approximately equal to 0.0315 inches (0.80 mm). This thickness may provide an optimal combination of insulating value, desired stability, and or permitted flexing of the sidewall 110 of the container 100. A thickness ($t_{610}$) of approximately 0.0315 inches (0.80 mm) may also be suitable for containers designed to hold less than 8 ounces or more than 26 ounces. Optionally, the thickness ($t_{610}$) of the gap 610 may range from approximately 0.020 inches (0.50 mm) to approximately 0.050 inches (1.27 mm). It is understood that to attain various qualities of the container 100, the gap 610 between the inner sleeve 200 and the outer sleeve 300 may be manufactured with different thicknesses and lengths and that these thicknesses and lengths need not be constant. Thus, in alternative embodiments, the gap thickness ($t_{610}$) may vary. For example, when the sidewall taper angle (γ) of the outer sleeve 300 is not equal to the sidewall taper angle (β) of the inner sleeve 200, the gap thickness ($t_{610}$) will vary. Further, stepwise changes in the geometry (whether vertically, horizontally and/or otherwise oriented) of the inner sleeve sidewall 210 and/or the outer sleeve sidewall 310 may result in a varying gap thickness ($t_{610}$).

In the embodiment of FIGS. 1-5 and as best shown in FIG. 5, when the inner sleeve 200 is placed in the outer sleeve 300, the lowermost end 208 of the inner sleeve 200 generally contacts and rests on the upper end 504 of the elongated loop 505 of the supporting rim 500. A height ($H_{208}$) from the horizontal supporting surface (S) to the lowermost end 208 of the inner sleeve 200 is shown in FIG. 5. In this embodiment, the height ($H_{208}$) may be equal or substantially equal to the height ($H_{500}$) of the supporting rim 500, and also, this height ($H_{208}$) may be equal or substantially equal to the height from the horizontal supporting surface (S) to the lowermost end 408 of the base element 400. According to alternative embodiments, the lowermost end 208 of inner sleeve 200 and/or the lowermost end of 408 of base element 400 need not rest on or contact the upper end 504 of the elongated loop 505. For example, the lowermost end 208 may be spaced a distance above the elongated loop 505.

The loop flange 530 extends adjacent the outer circumferential surface 213 of the lower end 206 of the inner sleeve sidewall 210 and is attached thereto. Specifically, an interior facing surface 531 of loop flange 530 is attached to the outer surface 213. In this embodiment, the loop flange extends over a vertical height that is less than the vertical height that the skirt 420 of the base element 400 extends over. Alternatively, the loop flange 530 may have an associated vertical height that is equal to or substantially equal to the associated vertical height of the skirt 420. In even other embodiments, the height of the loop flange may be greater than the height of the skirt 420.

In the embodiment of FIG. 5, the loop flange 530 generally does not contact the inner surface 311 of the outer sleeve sidewall 310 of the outer sleeve 300. In other embodiments (not shown), the exterior facing surface 533 of the loop flange 530 may contact the inner surface 311 of the outer sleeve 300, and may even be attached thereto. Accordingly, due to the geometry in the vicinity of the loop flange 530, a cavity 615 having a gap thickness ($t_{615}$) (referring to FIG. 4B) may be provided between the lower end 206 of the inner sleeve 200 and the surrounding portion of the outer sleeve 300.

Figure 6:
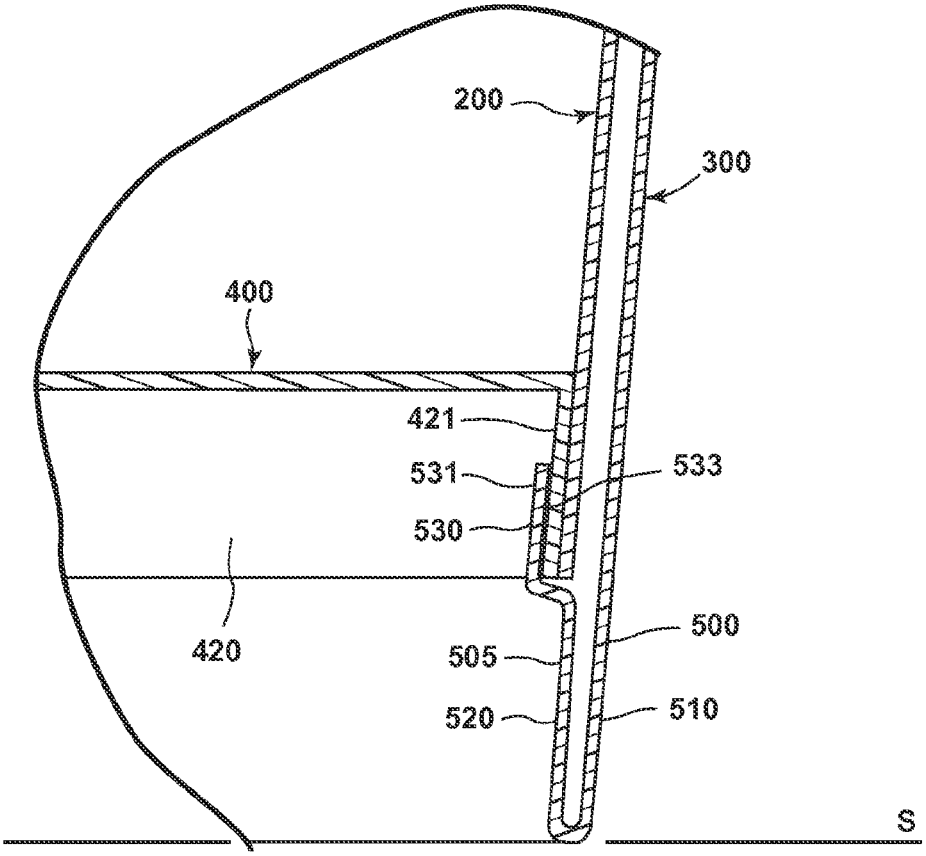
FIG. 6 is a cross-sectional view of a detail, similar to that identified in FIG. 2 for FIG. 5, for an alternative embodiment on the invention.

In an alternative embodiment illustrated in FIG. 6, the loop flange 530 extends adjacent the inner circumferential surface 421 of the skirt 420 of base element 400 and is attached thereto. Specifically, the exterior facing surface 533 of the loop flange 530 may be attached to the inner surface 421. In this embodiment, the top end of inner rim wall 520 extends inwardly, toward the centerline and away from outer rim wall 510.

Figure 7:
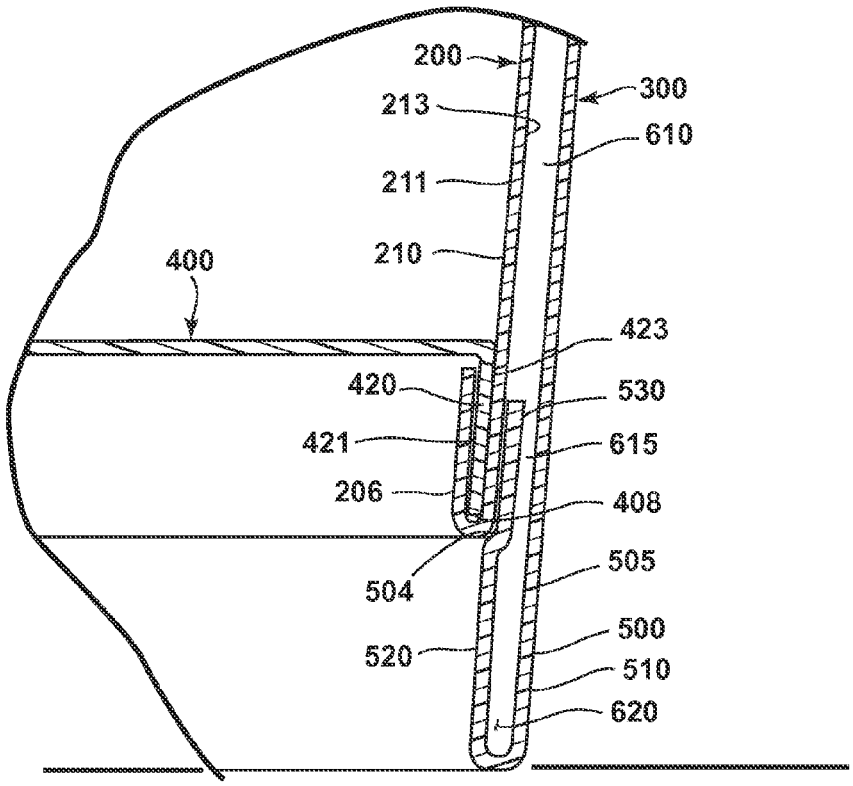
FIG. 7 is a cross-sectional view of a detail, similar to that identified in FIG. 2 for FIG. 5, for another alternative embodiment on the invention.

In a further alternative embodiment illustrated in FIG. 7, the lower end 206 of inner sleeve sidewall 210 is inwardly folded or rolled under the lowermost end 408 of skirt 420. In other words, the lower end 206 wraps around skirt 420. In this embodiment, sleeve 200 may be attached to both the inner surface 421 and the outer surface 423 of skirt 420. Wrapping and attaching the lower end 206 around skirt 420 may increase the rigidity of this portion of the container. As with the embodiment of FIG. 5, the loop flange 530 extends adjacent the outer circumferential surface 213 of the lower end 206 of the inner sleeve sidewall 210 and is attached thereto.

Various upper rim configurations may be provided at the upper end 104 of the container 100. Reference is made to U.S. Pat. No. 7,699,216, titled "Two-Piece Insulated Cup," issued to Smith et al. on Apr. 20, 2010, which is hereby incorporated by reference in its entirety, for its disclosure of various methods of forming rims. For example, as shown in FIG. 2, one embodiment of the container 100 includes an upper or top rim or lip 112 formed as an outwardly rolled portion 212 of the upper end 204 of the inner sleeve sidewall 210. The upper edge 302 of outer sleeve sidewall 310 extends into the region encompassed by the rolled portion of the upper rim 112. Thus, in this embodiment of the container 100, the inner sleeve 200 may have a rolled upper rim 212 formed thereon while the outer sleeve 300 does not. Alternative embodiments (not shown) are possible, however, wherein the inner sleeve 200 has no rim and the outer sleeve 300 has a rim, or wherein both the inner sleeve 200 and the outer sleeve 300 have rims. In the latter embodiment where both the inner sleeve 200 and the outer sleeve 300 have rims or rim portions, the rim 112 of the container 100 may be formed by rolling the rims of the inner sleeve 200 and the outer sleeve 300 together to form a unified rim 112 for the container 100. As another non-limiting option, the upper rim 112 of the container 100 may be formed by outwardly rolling the rim of the inner sleeve 200 around an inwardly-rolled rim of the outer sleeve 300.

In the embodiment of FIGS. 1-5, the inner sleeve 200, the outer sleeve 300 and the base 400 are all made from a paper substrate. As an example, the paper stock for the inner sleeve 200 may be approximately 0.0093 inch (0.24 mm) thick normal-sizing, medium-density uncoated paper. The paper stock for the outer sleeve 300 may be approximately 0.0113 inch (0.29 mm) thick normal-sizing, low-density uncoated paper. The paper stock for the base 400 may be approximately 0.0093 inch (0.24 mm) thick normal-sizing, medium-density uncoated paper. In alternate embodiments, the outer sleeve sidewall 310 may be thicker than the inner sleeve sidewall 210. Optionally, the outer sleeve sidewall 310 may be thicker than the base element 400. For example, the paper stock for the outer sleeve sidewall 310 of the outer sleeve 300 may be approximately 0.016 inch (0.40 mm) thick and the paper stock for the inner sleeve sidewall 210 and/or of the base 400 may be approximately 0.012 inch (0.30 mm). Variations in the sizing, density, and type of the stock paper may be employed without departing from the scope of the present invention. Using a paper material for the components of the container 100 provides several advantages: the components may be inexpensively produced on high-speed conventional cup forming equipment; the stiffness and rigidity of the container 100 may be maintained; the stock paper may be economically preprinted; and the paper material is biodegradable.

If paper is utilized as the material for the components of container 100, the paper need not have a coating, except where the paper is to contact the liquid in the container 100, which is typically the inner surface of the container 100. In one embodiment, the inner surface 211 of the inner sleeve 200 and the upper surface 411 of the bottom wall 410 will be coated while the outer surface 213 of the inner sleeve 200, the inner and outer surfaces 311 and 313 of the outer sleeve 300, and the lower surface 413 of the bottom wall 410 will not be coated. Alternatively or additionally, the outer surface 313 of the paper material of the outer sleeve 300 may be at least partially coated with a coating. Further, in certain embodiments, the lower surface 413 of bottom wall 410 may be at least partially coated. Various coatings include wax, polymer-based coatings such as a polyethylene or polypropylene based coating, coatings that are not polymer-based, and/or environmentally-friendly coatings such as biodegradable coatings, non-oil based resins, etc. Other coatings may be used and still fall within the scope of the present invention. As noted above, if a coating is utilized, it may be applied to one or both of the surfaces of the component. One purpose of using a coated paper-stock material may be to provide an insulation barrier against the transfer of heat through the wall of the component in both hot and cold applications. Another purpose may be to provide waterproofing. An additional purpose of the coated paper-stock material may be to foster adhesion or bonding during manufacturing of the container 100 and its individual components.

In a preferred embodiment, the inner sleeve 200, the outer sleeve 300 and the base 400 may be made from a paper substrate. However, it is understood that one or more of the inner sleeve 200, the outer sleeve 300 and the base 400 (or portions thereof) may, optionally, be made of materials other than paper without departing from the scope of the present invention. Specifically, the components may be made of a plastic material, a pulp-molded material, a foam material including a starch-based foam material, or other materials suitable for forming the components of the container 100.

Thus, according to certain embodiments, the component material may be a polymeric material, such as foamed material comprising polystyrene. The polymeric material may optionally be, but is not limited to, polypropylene, polyethylene, polyester, polystyrene, polycarbonate, nylon, acetate, polyvinyl chloride, saran, other polymer blends, biodegradable materials, etc. By selecting the desired plastic or non-polymer material and further selecting the appropriate properties for the selected material, the inner sleeve 200, outer sleeve 300 and/or base 400 may be formed of a material that is tailored to the product end use. As one example, one or more of the container components may be made of polystyrene foam. Thermoforming is an inexpensive forming process used to rapidly produce high volumes components. It is understood, however, that a variety of other forming methods for creating the components, may be utilized without departing from the scope of the present invention. For example, in other embodiments, one or more of the components may be made of a non-foamed plastic material, such as polypropylene. The material may be, but is not limited to, polyethylene, polyester, polystyrene, polycarbonate, nylon, acetate, polyvinyl chloride, saran, other polymer blends, biodegradable materials, etc. The thermoforming process may begin with a thin sheet or web of the plastic material, which is heated to a temperature suitable for thermoforming the plastic material, and is then fed into a mold cavity of a conventional forming machine.

A variety of methods may be utilized to fixedly connect the inner sleeve 200 to the outer sleeve 300, and it is understood that the methods disclosed herein are not exhaustive. For example, referring to FIG. 2, one assembly method that may be utilized is referred to as a pressure fit method. In the pressure fit method, the inner sleeve 200 having an upper rim 212 is positioned within the outer sleeve 300. In this embodiment, the outer sleeve 300 has no rim. Instead, the upper end 304 of the outer sleeve 300 terminates at the upper edge 302 of the outer sleeve sidewall 310. The upper edge 302 of the outer sleeve 300 is press fit under the upper rim 212 of the inner sleeve 200 to lock the outer sleeve 300 to the inner sleeve 200. Various other methods for assembling and affixing the upper edges, rims, lips of the inner sleeve 200 and the outer sleeve 300 may be used.

Alternatively and/or additionally, an adhesive may be utilized to join the outer sleeve 300 to the inner sleeve 200. One exemplary adhesive includes a formulated polyvinyl resin emulsion adhesive. This adhesive may have a viscosity of 1,800 to 2,500 centipoises at room temperature. It is understood, however, that depending on the materials of the inner sleeve 200, the outer sleeve 300 and the base 400, a variety of adhesives may be utilized under the scope of the present invention. When an adhesive is utilized, it is typically applied to an area adjacent the first end of the outer sleeve 300 prior to joining the outer sleeve 300 to the inner sleeve 200. It is understood that the adhesive may be provided in alternate areas of the inner sleeve 200 and/or outer sleeve 300 to connect the two components.

It is expected that the container 100 manufactured in accordance with the one of the examples described above (i.e., that shown in FIGS. 1-5 and having a paper outer sleeve 300 and a paper inner sleeve 200), will provide a substantial improvement for reducing the thermal transfer of heat to the outer sleeve 300 of the container 100. Accordingly, the double-walled container 100 of the present invention provides a simple and inexpensive means for improving the thermal insulating properties of beverage containers. Specifically, the container 100 may reduce heat transfer to the outer sleeve 300. As such, the present invention overcomes the deficiencies seen in the prior art.

Stacking of Containers/Sets of Containers:

In the embodiment of FIGS. 1-5, both the outer sleeve sidewall 310 of the outer sleeve 300 and the inner sleeve sidewall 210 of the inner sleeve 200 are frustoconical in shape. Further, the sidewall taper angle (β) for the outer sleeve 300 and the sidewall taper angle (γ) for the inner sleeve 200 are substantially equal. As illustrated in the embodiment of FIGS. 1-5, the outer sleeve sidewall 310 extends almost the entire height of the container 100 from the bottom edge 108 up to the upper rim 112, thus providing the container 100 with an exterior surface 113 extending almost the entire height of the container 100 up to, but below the upper rim 112. In this manner, the exterior surface 113 provides an uninterrupted surface in a single plane from the bottom edge 108 of the container 100 up to the upper rim 112 that maximizes the printable surface area of the container 100 and enhances the ability to provide the container 100 with a uniform appearance.

Figure 8:
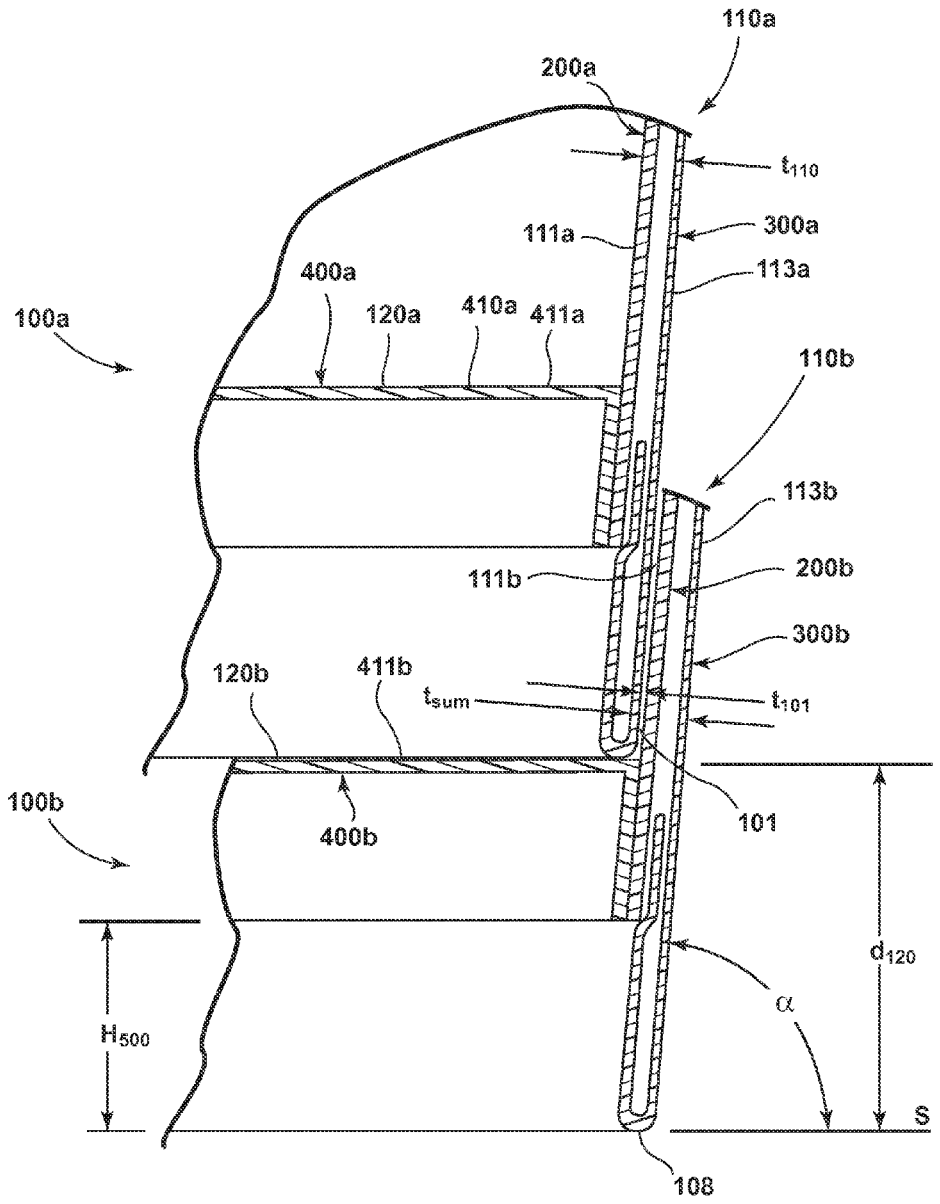
FIG. 8 is a cross-sectional view of a detail, similar to that identified in FIG. 2 for FIG. 5, for a set of first and second nested containers.

Thus, referring to FIG. 8, a first container 100*a* may be nested inside a second container 100*b*. In order to keep the nested containers 100 from wedging together, which would inhibit the ability to easily un-nest or remove a container from the stack, it is desirable that a stacking clearance 101 be provided as shown in FIG. 8. This stacking clearance 101 has a thickness ($t_{101}$) that is measured perpendicular to the sidewalls 110*a*, 110*b* of the containers 100*a*, 100*b*. Specifically, the stacking clearance 101 is the gap or spacing maintained between the outer surface 113*a* of container 100*a* and the inner surface 111*b* of container 100*b*. In a preferred embodiment, this stacking clearance 101 has a thickness ($t_{101}$) approximately equal to 0.016 inches (0.40 mm). This stacking clearance 101 may provide sufficient play to account for manufacturing tolerances, while at the same time maximizing the number of containers that may be stacked over a given height. In certain embodiments, the stacking clearance 101 may range from approximately 0.005 inches (0.13 mm) to 0.025 inches (0.64 mm).

Referring to FIGS. 5 and 8, the distance ($d_{120}$) of the receptacle floor 120 above the lowermost bottom edge 108 of the container sidewall 110 may be determined as a function of the frustoconical taper angle (α) of the container sidewall 110 and the sum of the thicknesses ($t_{sum}$) of the inner sleeve sidewall 210, the outer sleeve sidewall 310, the sidewall cavity 610 and the stacking clearance 101 ($t_{210}$, $t_{310}$, $t_{610}$ and $t_{101}$). According to one methodology, the vertical distance ($d_{120}$), plus or minus 5%, may be calculated by dividing the sum of the thicknesses ($t_{sum}$) by the cosine of the frustoconical taper angle (α).

According to another methodology and referring to FIG. 8, the vertical distance ($d_{120}$) from the lowermost bottom edge 108 of the container 100 to the upper surface 411 of the bottom wall 410 of the base element 400 is equal to or greater than the thickness ($t_{110}$) of the container sidewall 110 divided by the cosine of the container sidewall taper angle (α). The amount that the distance ($d_{120}$) is greater than the thickness ($t_{110}$) of the container sidewall 110 divided by the cosine of the container sidewall taper angle (α) provides a clearance between the nested cups. In other words, the dimension of the outer surface 113 at the lowermost bottom edge 108 of the container 100 will be less than the dimensions of the inner surface 211 of the inner sleeve sidewall 210 just above where the upper surface 411 of the bottom wall 410 extends inwardly from the inner sleeve 200. This clearance allows ease of cup removal from the stack of nested cups.

According to some aspects, the distance ($d_{120}$) may range from approximately 1.0 times to 5.0 times the vertical height ($H_{500}$) of the elongated loop 505. At a ratio of approximately 1.0, the distance ($d_{120}$) may be approximately equal to the thickness of the material forming the bottom wall 410 of the base element 400. By way of non-limiting examples, the ratio of the distance ($d_{120}$) to the vertical height ($H_{500}$) may be greater than approximately 1.0, greater than 1.5, greater than 1.75, greater than 2.0, greater than 2.5 or even greater than 2.5. For beverage containers designed to hold from 8 ounces to 26 ounces, a ratio of between approximately 1.75 and approximately 2.25 may be advantageous in terms of strength, stability and ease of manufacturing.

Table I discloses an example set of container dimensions for containers 100 having a paper inner sleeve 200 having a thickness ($t_{200}$) of 0.0130 inches (0.33 mm), a paper outer sleeve 300 having a thickness ($t_{300}$) of 0.0165 inches (0.42 mm), and a sidewall cavity 610 thickness ($t_{610}$) equal to 0.0315 inches (0.80 mm).

TABLE I

| Ex. | Container Capacity (oz) | Container Height $H_{100}$ (inches) | Top Rim Outer Diameter (inches) | Bottom Rim Outer Diameter (inches) | Taper Angle (α) | Height ($d_{120}$) (inches) | Height ($H_{208}$) (inches) |
|---|---|---|---|---|---|---|---|
| 1 | 25.16 | 7.330 | 3.858 | 2.207 | 95°38' | .784 | .375 |
| 2 | 21.11 | 6.516 | 3.670 | 2.364 | 94°49' | .914 | .410 |
| 3 | 21.20 | 6.247 | 3.858 | 2.149 | 96°54' | .644 | .345 |
| 4 | 17.23 | 5.840 | 3.540 | 2.206 | 95°31' | .804 | .385 |
| 5 | 17.41 | 5.414 | 3.670 | 2.307 | 96°08' | .719 | .360 |
| 6 | 13.59 | 4.558 | 3.540 | 2.250 | 96°50' | .649 | .345 |
| 7 | 14.17 | 4.381 | 3.670 | 2.324 | 97°30' | .589 | .330 |
| 8 | 12.13 | 4.309 | 3.345 | 2.253 | 96°09' | .719 | .365 |
| 9 | 10.07 | 3.678 | 3.345 | 2.247 | 97°18' | .604 | .335 |

Typically, when designing a set of containers that are similar, but vary in capacity, it is desirable to configure each container in the set to be useable with the same lid. A single lid for a container set can save on manufacturing costs and provide storage and ease of use benefits for the user. In order to be able to use the same, single mounting diameter lid with different capacity cups, the outside diameter of the top rim of each cup must be the same. In a double-walled container of a given top rim outside diameter, the vertical distance the container floor is recessed above the lowermost bottom edge of the container sidewall effects the overall height of the container for different capacity containers. For a given vertical distance the container floor is recessed above the lowermost bottom edge of the container sidewall and a given top rim outside diameter, as the capacity of the container changes, the vertical height of the container, bottom rim outside diameter and tip angle also change. As used herein, the tip angle refers to the angle relative to vertical that the centerline (℄) of a container which is filled to capacity can be tilted to without the container tipping over. The higher the tip angle, the farther the filled container can be tilted relative to vertical without tipping over.

Referring again to FIG. 5, the additive effect of the height $H_{500}$ of the supporting rim 500 of the outer sleeve 300 and the vertical distance $d_{410}$ of the bottom wall 410 of the base element 400 above the lowermost end 208 of the inner sleeve 200 provide for increased flexibility in designing the overall distance $d_{120}$ of the container floor 120 above the surface. The increase design flexibility in the vertical distance of the container floor above the surface provides greater flexibility in designing containers having increasing capacity with a constant top rim outside diameter while providing a container having the desired vertical height, bottom rim outside diameter and tip angle.

Figure 9B:
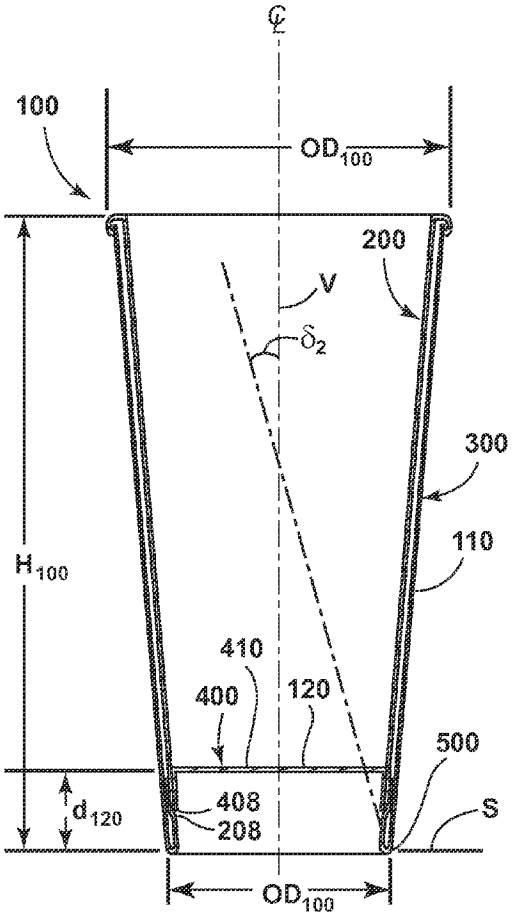
FIG. 9B is a cross-sectional view of an embodiment of the double-walled container of FIG. 1.
Figure 9A:
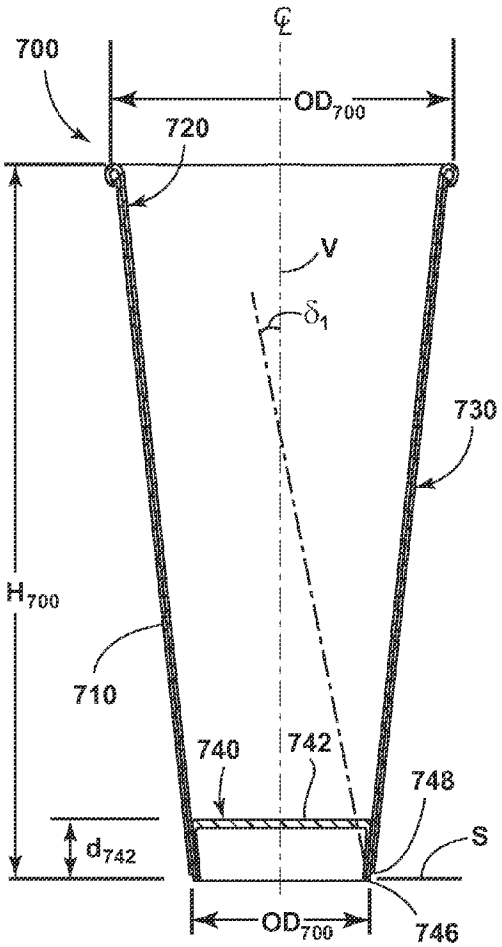
FIG. 9A (PRIOR ART)
FIG. 9A is a cross-sectional view of a double-walled container according to the prior art.

By way of example, FIGS. 9A and 9B provide an illustrative example of the effect of distance of the container floor above the surface on the overall vertical height and tip angle of the container in the context of a 20 fluid ounce cup having a top rim outside diameter of 3.540 inches. Referring now to FIG. 9A, an exemplary traditional double-walled container 700 is illustrated. The double-walled container 700 can be a cup having a frustoconically configured container sidewall 710 having an inner sleeve 720, an outer sleeve 730 and a base element 740 defining a receptacle floor 742. The uppermost top edge of the inner sleeve 720 includes a top rim 744 which defines an upper outside diameter $OD_{700}$ for the container 700. The lowermost edge of the inner sleeve 720 includes a bottom edge 746 which defines a lower outside diameter $OD_{700}$ of the container 700. As illustrated in FIG. 9A, the outer sleeve 730 extends at least a portion of the length of the sidewall 710 and has a bottom edge 748 adjacent the inner sleeve bottom edge 746.

Thus, in a traditional double-walled container, the vertical distance $d_{742}$ of the receptacle floor 742 is limited to the vertical distance of the base element 740 relative to the bottom edge 746 of the inner sleeve 720. This distance is limited based on the methods and equipment used to assemble the inner sleeve 720 and the base element 740. In the case of assembling an inner sleeve 720 and the base element 740 made from a fiber-based material such as paper, the vertical distance $d_{742}$ is limited to approximately 0.62 inches. With a maximum vertical distance $d_{742}$ of 0.62 inches and top rim outside diameter $OD_{700}$ of 3.540 inches, the vertical height $H_{700}$ of the container sidewall 710 necessary to provide a 20 fluid ounce capacity container is 7.400 inches. These dimensions provide a 20 fluid ounce capacity container having a tip angle $\delta_1$ relative to a vertical axis V of the container on the surface S of about 11.2 degrees.

For comparison, FIG. 9B illustrates the container 100 described herein having dimensions corresponding to a 20 fluid ounce cup with a top rim outside diameter $OD_{100}$ of 3.540 inches. As discussed above, the additive effect of the height of the supporting rim 500 of the outer sleeve 300 and the vertical distance of the bottom wall 410 of the base element 400 above the lowermost end 208 of the inner sleeve provide for increased flexibility in designing an overall distance $d_{120}$ of the container floor 120 above the surface for a given cup capacity and top rim outside diameter to provide a desired cup tilt angle and vertical sidewall height. In the exemplary embodiment of FIG. 9B, the combined height of the supporting rim 500 and the vertical distance of the bottom wall 410 above the lowermost end 208 can be configured to provide an overall distance $d_{120}$ of the container floor 120 of 0.781 inches. This distance, in combination with the desired top rim outside diameter $OD_{100}$ of 3.540 inches results in a container having a vertical height $H_{100}$ of 6.610 inches and a tilt angle $\delta_2$ of 15.8 degrees. The greater overall distance $d_{120}$ for the container 100 compared to the overall distance $d_{742}$ for the container 700 provides a cup having the same capacity and the same top rim outside diameter, but with a shorter sidewall height, a larger tilt angle, and a larger bottom rim outside diameter, resulting in a more stable cup.

The increased design flexibility provided by the additive effect of the height of the supporting rim 500 of the outer sleeve 300 provides increased flexibility in the configuration of the dimensions of the container, such as the vertical sidewall height, bottom rim outside diameter, and tilt angle in designing containers having a predetermined top rim outside diameter and capacity. In a traditional double-walled container where the vertical height of the container floor above the surface is based only on the configuration of the inner sleeve and the base element, the number of design configurations available to provide a desired top rim outside diameter, bottom rim outside diameter and/or tip angle is limited, especially as the capacity of the container increases. The additive effect of the height of the supporting rim in combination with the vertical height provided by the assembled inner sleeve and base element increases the number of combinations of container dimensions which can provide a desired combination of top rim outside diameter, bottom rim outside diameter and/or tip angle configurations.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention and the scope of protection is only limited by the scope of the accompanying claims.

I claim:

1. A double-walled container comprising:

an inner sleeve including an inner sleeve sidewall having an upper end, a lower end, and an outer surface extending therebetween;

a base extending inwardly from the inner sleeve sidewall and having a bottom wall with a downwardly depending skirt, the inner sleeve sidewall and the base together defining a receptacle having an opening at the upper end of the inner sleeve; and an outer sleeve including an outer sleeve sidewall having an upper end, a lower end, and an inner surface extending therebetween;

the inner sleeve positioned within the outer sleeve, the inner surface of the outer sleeve sidewall positioned outwardly from the outer surface of the inner sleeve sidewall;

wherein the lower end of the outer sleeve forms an elongated loop having a loop cavity located below a lowermost edge of the inner sleeve with the lowermost edge of the inner sleeve positioned outside the loop cavity; and wherein a flange extends from the elongated loop upwardly above the lowermost edge of the inner sleeve and is attached to the inner sleeve; and the flange extends upwardly between the outer surface of the inner sleeve and the inner surface of the outer sleeve.

2. The container of claim 1, wherein the elongated loop located below the lowermost edge of the inner sleeve has a vertical height to width ratio of at least two, wherein the width is measured between an outermost surface and an innermost surface of the elongated loop.

3. The container of claim 1, wherein an inner rim wall of the elongated loop extends parallel to an outer rim wall of the elongated loop.

4. The container of claim 1, wherein the inner surface of the outer sleeve sidewall is spaced outwardly from the outer surface of the inner sleeve sidewall to form a sidewall cavity between the inner sleeve sidewall and the outer sleeve sidewall, and wherein the loop cavity and the sidewall cavity are in fluid communication.

5. The container of claim 1, wherein the inner surface of the outer sleeve sidewall is spaced outwardly from the outer surface of the inner sleeve sidewall to form a sidewall cavity between the inner sleeve sidewall and the outer sleeve sidewall, and wherein the sidewall cavity extends substantially around the entire circumference of the inner sleeve sidewall.

6. The container of claim 1, wherein the outer sleeve sidewall extends parallel to the inner sleeve sidewall.

7. The container of claim 1, wherein the inner and outer sleeves are smooth-walled.

8. The container of claim 1, wherein the inner sleeve is linearly tapered from its upper end to its lower end and wherein the outer sleeve is linearly tapered from its upper end to its lower end.

9. The container of claim 1, wherein the inner sleeve and the outer sleeve are formed of paper material.

10. A double-walled container comprising:

an inner sleeve including an inner sleeve sidewall having an upper end, a lower end, and an outer surface extending therebetween;

a base extending inwardly from the inner sleeve sidewall and having a bottom wall with a downwardly depending skirt, the inner sleeve and the base together defining a receptacle; and an outer sleeve including an outer sleeve sidewall having an upper end, a lower end, and an inner surface extending therebetween;

wherein the inner sleeve is positioned within the outer sleeve, the inner surface of the outer sleeve sidewall spaced outwardly from the outer surface of the inner sleeve sidewall and forming a first cavity between the inner sleeve sidewall and the outer sleeve sidewall;

wherein the lower end of the outer sleeve forms an elongated loop having an upper end extending below a lowermost edge of the inner sleeve with the lower end of the inner sleeve resting on the upper end of an outer surface of the elongated loop; and wherein the elongated loop forms a second cavity in fluid communication with the first cavity.

11. The container of claim 10, wherein the outer sleeve sidewall extends parallel to the inner sleeve sidewall.

12. The container of claim 10, wherein the outer sleeve contacts the inner sleeve only at the upper end of the inner sleeve and at the lower end of the inner sleeve.

13. The container of claim 10, wherein the first cavity has a constant width between the upper end of the inner sleeve and the base of the receptacle.

14. The container of claim 10, wherein the first cavity is devoid of any structure extending between the inner sleeve and the outer sleeve.

15. The container of claim 10, further comprising:

a flange extending upwardly from the elongated loop and positioned between the inner sleeve and the outer sleeve.

16. The container of claim 10, wherein the inner surface of the inner sleeve is smooth-walled and linearly tapered from the upper end to the lower end, and wherein the outer surface of the outer sleeve is smooth-walled and linearly tapered from the upper end to the lower end.

17. A double-walled container comprising:

an inner sleeve including an inner sleeve sidewall having a upper end, a lower end, and an inner surface extending therebetween;

a base extending inwardly from the inner sleeve sidewall and having a bottom wall with a downwardly depending skirt, the inner sleeve sidewall and the base together defining a vessel; and an outer sleeve including an outer sleeve sidewall having an upper end, a lower end, and an outer surface extending therebetween, wherein the lower end of the outer sleeve forms an elongated loop having a loop cavity located below a lower end of the inner sleeve with the lowermost edge of the inner sleeve positioned outside the loop cavity;

wherein the outer sleeve sidewall defines a sidewall taper angle measured from a horizontal supporting surface and wherein the outer sleeve sidewall extends generally parallel to the inner sleeve sidewall; and wherein the base is recessed upward from a lowermost edge of the outer sleeve, such that a vertical distance from the lowermost edge of the outer sleeve to an upper surface of the base, measured where the base meets the inner sleeve sidewall, is greater than a thickness dimension from the outer surface of the outer sleeve sidewall to the inner surface of the inner sleeve sidewall, measured at the base, divided by the cosine of the sidewall taper angle.

18. The container of claim 17, wherein the elongated loop includes an upwardly extending flange that extends above the lowermost edge of the inner sleeve and is positioned between the outer surface of the inner sleeve and the inner surface of the outer sleeve.

19. The container of claim 18, wherein a ratio of the vertical distance from the lowermost edge of the outer sleeve to the upper surface of the base to a vertical height of the elongated loop may range from approximately 1.75 to approximately 2.25.

20. The container of claim 17, wherein the inner surface of the inner sleeve is smooth-walled and linearly tapered from the upper end to the lower end, and wherein the outer surface of the outer sleeve is smooth-walled and linearly tapered from the upper end to the lower end.

21. The container of claim 17, wherein a sidewall cavity having a constant thickness is defined between the inner sleeve sidewall and the outer sleeve sidewall, wherein the sidewall cavity extends form the upper end of the inner sleeve to the lower end of the inner sleeve, and wherein the sidewall cavity is devoid of any structure extending between the inner sleeve and the outer sleeve.

22. A double-walled container comprising:

an inner sleeve including an inner sleeve sidewall having an upper end, a lower end, and an outer surface extending therebetween;

a base extending inwardly from the inner sleeve sidewall and having a bottom wall with a downwardly depending skirt, the inner sleeve sidewall and the base together defining a receptacle having an opening at the upper end of the inner sleeve; and an outer sleeve including an outer sleeve sidewall having an upper end, a lower end, and an inner surface extending therebetween;

the inner sleeve positioned within the outer sleeve, the inner surface of the outer sleeve sidewall positioned outwardly from the outer surface of the inner sleeve sidewall;

wherein the lower end of the outer sleeve forms an elongated loop having a loop cavity located below a lowermost edge of the inner sleeve with the lowermost edge of the inner sleeve positioned outside the loop cavity; and a flange, spaced from the bottom wall, extends from the elongated loop upwardly above the lowermost edge of the inner sleeve and is attached to the inner sleeve.

23. A double-walled container comprising:

an inner sleeve including an inner sleeve sidewall having an upper end, a lower end, and an outer surface extending therebetween;

a base extending inwardly from the inner sleeve sidewall and having a bottom wall with a downwardly depending skirt, the inner sleeve sidewall and the base together defining a receptacle having an opening at the upper end of the inner sleeve; and an outer sleeve including an outer sleeve sidewall having an upper end, a lower end, and an inner surface extending therebetween;

the inner sleeve positioned within the outer sleeve, the inner surface of the outer sleeve sidewall positioned outwardly from the outer surface of the inner sleeve sidewall;

wherein the lower end of the outer sleeve forms an elongated loop having a loop cavity located below a lowermost edge of the inner sleeve with the lowermost edge of the inner sleeve positioned outside the loop cavity; and a flange extends from the elongated loop upwardly above the lowermost edge of the inner sleeve and is attached to the inner sleeve, and the flange terminates below the level of the bottom wall.

24. A double-walled container comprising:

an inner sleeve including an inner sleeve sidewall having an upper end, a lower end, and an outer surface extending therebetween;

a base extending inwardly from the inner sleeve sidewall and having a bottom wall with a downwardly depending skirt, the inner sleeve sidewall and the base together defining a receptacle having an opening at the upper end of the inner sleeve; and an outer sleeve including an outer sleeve sidewall having an upper end, a lower end, and an inner surface extending therebetween;

the inner sleeve positioned within the outer sleeve, the inner surface of the outer sleeve sidewall positioned outwardly from the outer surface of the inner sleeve sidewall;

wherein the lower end of the outer sleeve forms an elongated loop having a loop cavity located below a lowermost edge of the inner sleeve with the lowermost edge of the inner sleeve positioned outside the loop cavity; and a flange extends from the elongated loop upwardly above the lowermost edge of the inner sleeve and is attached to the inner sleeve; and the flange at least partially closes the loop cavity.

* * * * *